US007381004B2

(12) United States Patent
Furukawa et al.

(10) Patent No.: US 7,381,004 B2
(45) Date of Patent: Jun. 3, 2008

(54) GAS PRESSURIZED WRITING INSTRUMENT AND WRITING INSTRUMENT REFILL

(75) Inventors: Kazuhiko Furukawa, Kouza-gun (JP); Kiyoshi Fujisawa, Takasaki (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 343 days.

(21) Appl. No.: 10/502,741

(22) PCT Filed: Jan. 30, 2003

(86) PCT No.: PCT/JP03/00926

§ 371 (c)(1),
(2), (4) Date: Jul. 28, 2004

(87) PCT Pub. No.: WO03/064176

PCT Pub. Date: Aug. 7, 2003

(65) Prior Publication Data

US 2005/0117960 A1 Jun. 2, 2005

(30) Foreign Application Priority Data

Jan. 30, 2002 (JP) ..... 2002-021786
Jan. 30, 2002 (JP) ..... 2002-021792

(51) Int. Cl.
*A46B 11/02* (2006.01)

(52) U.S. Cl. ..... 401/187

(58) Field of Classification Search ..... 401/187, 401/188 R, 190
See application file for complete search history.

(56) References Cited

U.S. PATENT DOCUMENTS 3,130,711 A 4/1964 Eckerle
3,997,273 A * 12/1976 Germann ..... 401/190
6,926,458 B2 * 8/2005 Maki et al. ..... 401/215

FOREIGN PATENT DOCUMENTS

| | | | |
|---|---|---|---|
| EP | 0 123 521 | | 10/1984 |
| GB | 1012158 | | 12/1965 |
| JP | 50-122325 | | 9/1975 |
| JP | 149139 | | 12/1975 |
| JP | 52-15859 | | 4/1977 |
| JP | 52-48536 | | 12/1977 |
| JP | 53-45694 | | 11/1978 |
| JP | 58-120084 | U | 8/1983 |
| JP | 61-12122 | Y2 | 4/1986 |
| JP | 2-135281 | U | 11/1990 |
| JP | 4-10076 | Y2 | 3/1992 |
| JP | 2001-341492 | | 12/2001 |

* cited by examiner

*Primary Examiner*—Huyen Le
(74) *Attorney, Agent, or Firm*—Buchanan, Ingersoll & Rooney, P.C.

(57) ABSTRACT

A gas-pressurized writing instrument simply constructed so that a compressed gas will not escape to the outside by providing a writing point assembly (10) at the front end (14*a*) of a tube member (14), storing an ink (12) to be fed to the writing point assembly (10) in the tube member (14), encasing at least part of the tube member (10) by a casing cylinder (18) so as to form a space (16) communicating with the rear opening of tube member (14), and sealing a compressed gas inside the space (16) so that the compressed gas will push the ink out to writing point assembly (10) to secure the writing performance, wherein the casing cylinder (18) is formed of a material that presents low gas permeability or gas impermeability.

4 Claims, 12 Drawing Sheets

GAS PRESSURIZED WRITING INSTRUMENT AND WRITING INSTRUMENT REFILL

TECHNICAL FIELD

The present invention relates to a gas-pressurized writing instrument and a writing instrument refill.

BACKGROUND ART

Conventionally, there have been known various types of gas-pressurized writing instruments, which, with a compressed gas sealed in the barrel cylinder, force out ink therefrom by making use of the pressure of the gas. This gas-pressurized writing instrument enables smooth writing, and writing in an upward position, (with an ordinary ball-point pen, air is sucked from the writing point, as a result, ink flows backwards) because a force for pushing the ink out is exerted by the compressed gas therein.

Various types of the gas-pressurized writing instruments have been proposed.

For example, Japanese Utility Model Application Laid-open Sho 58 No. 120084 discloses a double-fold structure, as shown in FIG. 2, in which a pressure check cylinder is arranged outside an ink storage tube and a compressed gas is sealed in the tube. In writing, the compressed gas provides the function of pushing out the ink, producing smooth writing sensation and enabling writing in an upward position, writing in water or in a weightless state or under other conditions (conventional example 1).

In the conventional example 1, however, the ink storage tube is arranged to stick out from the plug and be in contact with the outside air. Since the compressed gas also permeates through the ink storage tube to the outside, there is a fear that the compressed gas will escape to the outside via the ink storage tube. Therefore, it is necessary to select a material through which the compressed gas hardly permeates, for that of the ink storage tube.

Further, the ink storage tube should have resistance to ink for storage of ink therein.

Though provision of a transparent ink storage tube makes it possible to monitor the remaining amount of ink from the outside, selection of a material under the above conditions for prevention against permeation of the compressed gas and possession of resistance to ink, generally entails difficulties such that the ink storage tube becomes large in wall thickness. Further, the selection becomes extremely difficult if formability is considered and also clear drain performance or the property of causing ink not to adhere to the inner wall of the ink storage tube is wanted, so as to maintaining the ink storage tube clear after ink consumption. When clear drain performance needs to be kept, polypropylene (PP) that presents high permeability to gas has been used.

Japanese Utility Model Application Laid-open Sho 57 No. 121575 also discloses a gas pressurized ball-point pen having a similar double-folded tube, producing smooth writing sensation and enabling writing in an upward position (conventional example 2).

However, also in this conventional example 2, the ink storage tube is arranged so as to stick out of the barrel cylinder, and ink is stored in the ink storage tube. In the conventional example 2, the projected ink storage tube is covered with a holder, but this holder merely covers the front end of the ink storage tube. Further, in consideration of the use of a thread for fixture, ambient air is allowed to easily permeate, which practically means that the ink storage tube is put in direct contact with the outside air. There is a method of sealing by using a sealing material, but is it markedly difficult to select a material which is greasy and has high gas permeability.

Accordingly, in the conventional example 2, selection of a material that meets the above same conditions as in the conventional example 1, i.e., prevention against permeation of the compressed gas and possession of resistance to ink, generally entails difficulties. Further, the selection becomes extremely difficult if clear drain performance, formability and transparency are considered.

The basic configuration of a gas-pressurized ball-point pen as one kind of the gas-pressurized writing instruments is composed of a point assembly for a writing point, an ink storage tube that is connected to the point assembly and stores ink and compressed gas therein, and a tail plug disposed at the rear end of the ink storage tube. For the ink storage tube, several techniques using transparent resin so as to permit the remaining amount of ink therein to be monitored have been disclosed. However, some cases depending on the used resin suffer the gas leakage problem. Specifically, there occurs the problem in that the compressed gas permeates through the resin and leaks out from the interior of the ink storage tube to the outside.

In view of the problems in the conventional art, it is therefore an object of the present invention to provide a gas-pressurized writing instrument and a writing instrument refill, which can prevent gas leakage with a simple configuration and which is advantageous in appearance. It is also an object of the present invention to provide a gas-pressurized writing instrument and a writing instrument refill, which can prevent gas leakage with a simple structure of a fewer number of parts.

DISCLOSURE OF INVENTION

In order to achieve the above objects, the first aspect of the invention is a gas-pressurized writing instrument comprising: a tube member which has a writing point assembly at the front end thereof, stores ink therein to be fed to the writing point assembly and is closed at the rear end; and a compressed gas sealed in the tube member, and is characterized in that a gas barrier layer that presents low gas permeability or gas impermeability is formed on, at least part of the inner surface or outer surface of the tube member.

The second aspect of the present invention is that defined in the first aspect, wherein the material for the gas barrier layer is ethylene vinyl alcohol copolymer (EVOH).

The third aspect of the present invention is that defined in the first aspect, wherein the material for the tube member is any one of polyethylene terephthalate (PET), nylon, polyethylene naphthalate (PEN) and polybutylene terephthalate (PBT), and the material for the gas barrier is ethylene vinyl alcohol copolymer (EVOH).

The fourth aspect of the present invention is that defined in any one of the first to third aspects, wherein at least part of the periphery of the tube member is covered by a moisture-proof exterior member.

The fifth aspect of the present invention is that defined in any one of the first to fourth aspects, wherein at least part of the tube member is made of transparent or translucent resin so as to allow the interior ink to be monitored.

The sixth aspect of the present invention is a writing instrument refill characterized in that the refill is integrally formed of the writing point assembly and tube member defined in any one of the first to fifth aspects and can be removably fitted to the barrel cylinder of a writing instrument.

The seventh aspect of the present invention is a configuration comprising: a tube member which has a writing point assembly at the front end thereof, stores ink therein to be fed to the writing point assembly, and opens at the rear end; and a casing cylinder which creates a space communicating with the rear opening of the tube member and encases at least part of the tube member, and is characterized in that the casing cylinder is formed of a material that presents low gas permeability or gas impermeability, and a compressed gas is sealed in the space formed between the tube member and the casing cylinder.

The eighth aspect of the present invention is a configuration comprising: a tube member which has a writing point assembly at the front end thereof, stores ink therein to be fed to the writing point assembly, and opens at the rear end; and a casing cylinder which is confined at the rear end, creates a space communicating with the rear opening of the tube member and encases at least part of the tube member, and is characterized in that the casing cylinder has a gas barrier layer that presents low gas permeability or gas impermeability, formed on at least part of the inner surface or outer surface thereof, and a compressed gas is sealed in the space formed between the tube member and the casing cylinder.

The ninth aspect of the present invention is that defined in the eighth aspect, wherein the material for the gas barrier layer is ethylene vinyl alcohol copolymer (EVOH).

The tenth aspect of the present invention is that defined in any one of the seventh to ninth aspects, wherein the casing cylinder and the writing point assembly are joined so as to encase the tube member in the casing cylinder, keeping the tube member out of contact with the outside air.

The eleventh aspect of the present invention is that defined in any one of the seventh to ninth aspects, wherein a joint which keeps the space between the tube member and the casing cylinder airtight and is formed of a material that presents low gas permeability or gas impermeability is provided between the casing cylinder and the writing point assembly, so as to encase the tube member in the casing cylinder, keeping the tube member out of contact with the outside air.

The twelfth aspect of the present invention is that defined in any one of the seventh to ninth aspects, wherein a joint which keeps the space between the tube member and the casing cylinder airtight is provided between the casing cylinder and the writing point assembly, so as to encase the tube member in the casing cylinder, keeping the tube member out of contact with the outside air, and a gas barrier layer that presents low gas permeability or gas impermeability is formed on, at least part of the inner surface or outer surface of the joint.

The thirteenth aspect of the present invention is that defined in any one of the seventh to ninth aspects, wherein a joint which keeps the space between the tube member and the casing cylinder airtight and is formed of a material that presents low gas permeability or gas impermeability is provided between the tube member and the casing cylinder.

The fourteenth aspect of the present invention is that defined in any one of the seventh to ninth aspects, wherein a joint which keeps the space between the tube member and the casing cylinder airtight is provided between the tube member and the casing cylinder, and a gas barrier layer that presents low gas permeability or gas impermeability is formed on, at least part of the inner surface or outer surface of the joint.

The fifteenth aspect of the present invention is that defined in the twelfth or fourteenth aspect, wherein the material for the gas barrier layer is ethylene vinyl alcohol copolymer (EVOH).

The sixteenth aspect of the present invention is that defined in any one of the seventh to tenth aspects, wherein a reduced diametric portion having a smaller diameter is formed in the rear part of the writing point assembly, and the rear end of the reduced diametric portion is fixed to the tube member while the casing cylinder is joined to the reduced diametric portion.

The seventeenth aspect of the present invention is that defined in anyone of the eleventh to fifteenth aspects, wherein a reduced diametric portion having a smaller diameter is formed in the rear part of the writing point assembly, and the rear end of the reduced diametric portion is fixed to the tube member while the casing cylinder is joined to the reduced diametric portion.

The eighteenth aspect of the present invention is that defined in any one of the seventh to seventeenth aspects, wherein airtight closure joint sites for keeping the space between the tube member and the casing cylinder airtight are disposed locally around the writing point assembly.

The nineteenth aspect of the present invention is that defined in any one of the seventh to eighteenth aspects, wherein at least part of the periphery of the casing cylinder is covered by a moisture-proof exterior member.

The twentieth aspect of the present invention is that defined in anyone of the seventh to nineteenth aspects, wherein at least part of the tube member or/and the casing cylinder is made of transparent or translucent resin so as to allow the interior ink to be monitored.

The twenty-first aspect of the present invention is that defined in any one of the seventh to twentieth aspects, wherein the volume of the space provided between the tube member and the casing cylinder is formed to be 2 to 10 times the volume of ink initially stored in the tube member, and a compressed gas is charged so that the pressure inside the space when almost all ink has been consumed at just before the end of writing life is set to be 0.15 MPa to 0.6 MPa.

The twenty-second aspect of the present invention is that defined in any one of the seventh to twenty-first aspects, wherein ink is kept out of contact with the casing cylinder or/and the joint.

The twenty-third aspect of the present invention is a writing instrument refill characterized in that the refill is integrally formed of the writing point assembly, tube member and casing cylinder defined in any of seventh to twenty-second aspects and can be removably fitted to the barrel cylinder of a writing instrument.

BEST MODE FOR CARRYING OUT THE INVENTION

The embodiment of the present invention will be detailed with reference to the drawings.

Embodiment 1

Figure 1:
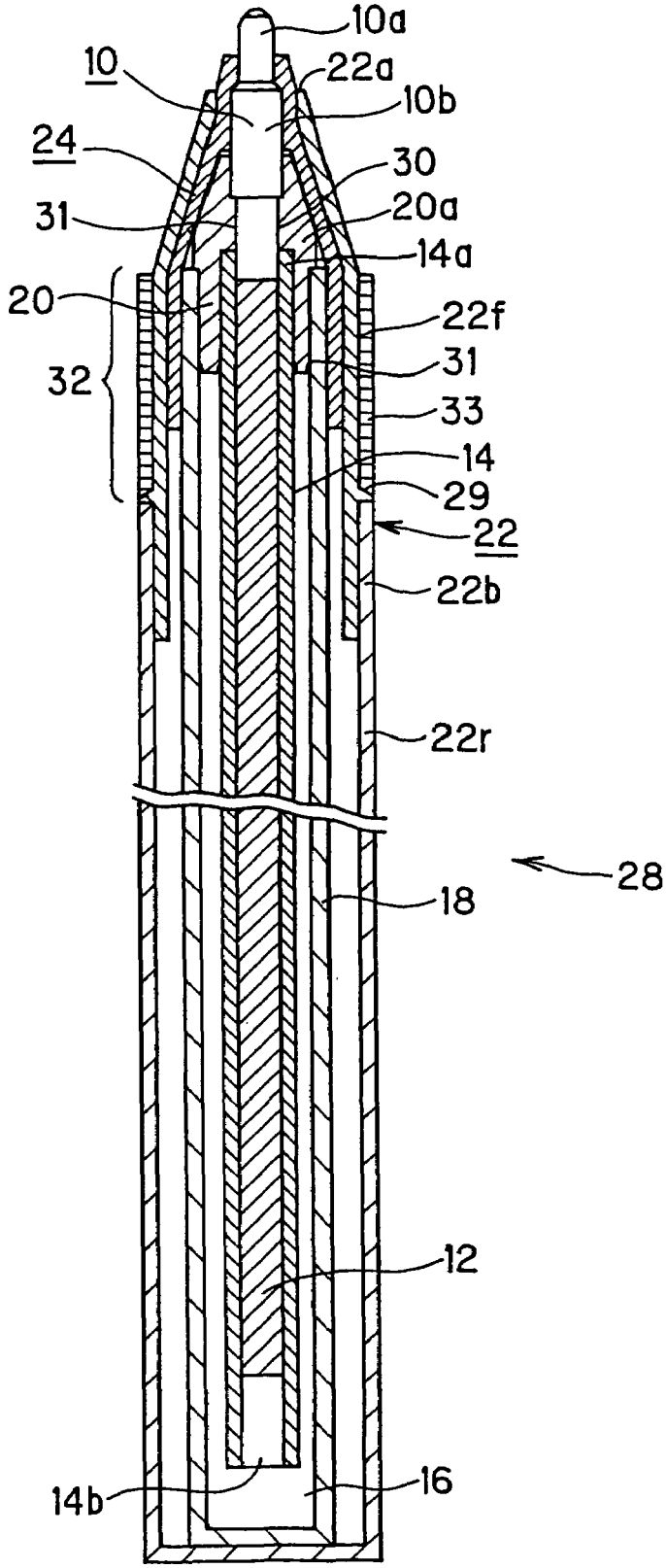
FIG. 1 is a vertical sectional illustrative view showing a gas-pressurized writing instrument to which an embodiment 1 of the present invention is applied.

As shown in FIG. 1, the embodiment 1 is a gas-pressurized writing instrument including: an elongate, cylindrical resin tube member 14, which has a writing point assembly 10, made of metal or preferably a gas impermeable or low-permeable resin, holding a writing ball at the front end thereof and disposed at a front end 14*a* of the tube member, opens to the rear (at the rear end) and stores therein an ink 12, selectable from various types such as oil-based ink, water-based ink, thixotropic ink and the like, to be supplied to the writing point assembly 10 (a follower may be provided at the ink rear end); a casing cylinder 18 which is closed at the rear and encases the tube member 14, forming a space 16 that communicates with a rear end opening 14*b* of the tube member 14, wherein the casing cylinder 18 is formed of a material that presents low gas permeability or gas impermeability; and a compressed gas (dry air or nitrogen gas) charged and sealed in the space 16 formed between the tube member 14 and the casing cylinder 18. In this gas-pressurized writing instrument, as will be detailed later, a joint member 20 is provided, which holds the tube member 14 and writing point assembly 10 with the rear end of writing point assembly 10 being fitted to the front end of tube member 14, at around their fitted portion, within a passage-hole 30 formed therein. A point assembly holder 24 is provided covering the periphery of the joint member 20 and writing point assembly 10. Further, an exterior member 22 as a constituent of a barrel cylinder 28 of the gas-pressurized writing instrument is provided covering the point assembly holder 24 and the casing cylinder 18.

In this gas-pressurized writing instrument, joint member 20 for keeping the space 16 between the tube member 14 and the casing cylinder 18 airtight (in this embodiment, the joint member 20 is joined to writing point assembly 10 and casing cylinder 18) is provided. This joint member 20 is formed of a material that presents low gas permeability or gas impermeability. Here, the concept of 'joining' includes fitting, bonding, welding and the like.

Joint member 20 has a hollow, approximately cylindrical configuration (having passage hole 30 penetrating therethrough) having a front end portion 20*a* enlarged flange-like, and most part of it other than the front end portion 20*a* sinks into the interior from the front end of casing cylinder 18. The flange-like front end portion 20*a* abuts the front end of casing cylinder 18 so that it will not sink into casing cylinder 18 more deeply.

Joint member 20 that keeps the space between tube member 14 and the casing cylinder 18 airtight and is formed of a material having low gas permeability or gas impermeability, is disposed between casing cylinder 18 and writing point assembly 10 while writing point assembly 10 is fitted into insertion hole 30 formed in joint member 20 and the tube member 14 joined to the rear end of writing point assembly 10 is enclosed in casing cylinder 18 so that the tube member 14 will not be in contact with the external air. This arrangement makes it possible to broaden the variation of material choice of tube member 14, so that the tube member 14 can be formed of a resin material other than that presenting low gas permeability or gas impermeability. As a result, a material that is excellent in oil resistance, liquid resistance, transparency, formability and clear drain performance, for example, can be used. Specifically, polypropylene (PP), polyethylene (PE) and the like can be used. It should be added that joint member 20 may be colored so as to enable distinction of ink color.

Figure 2:
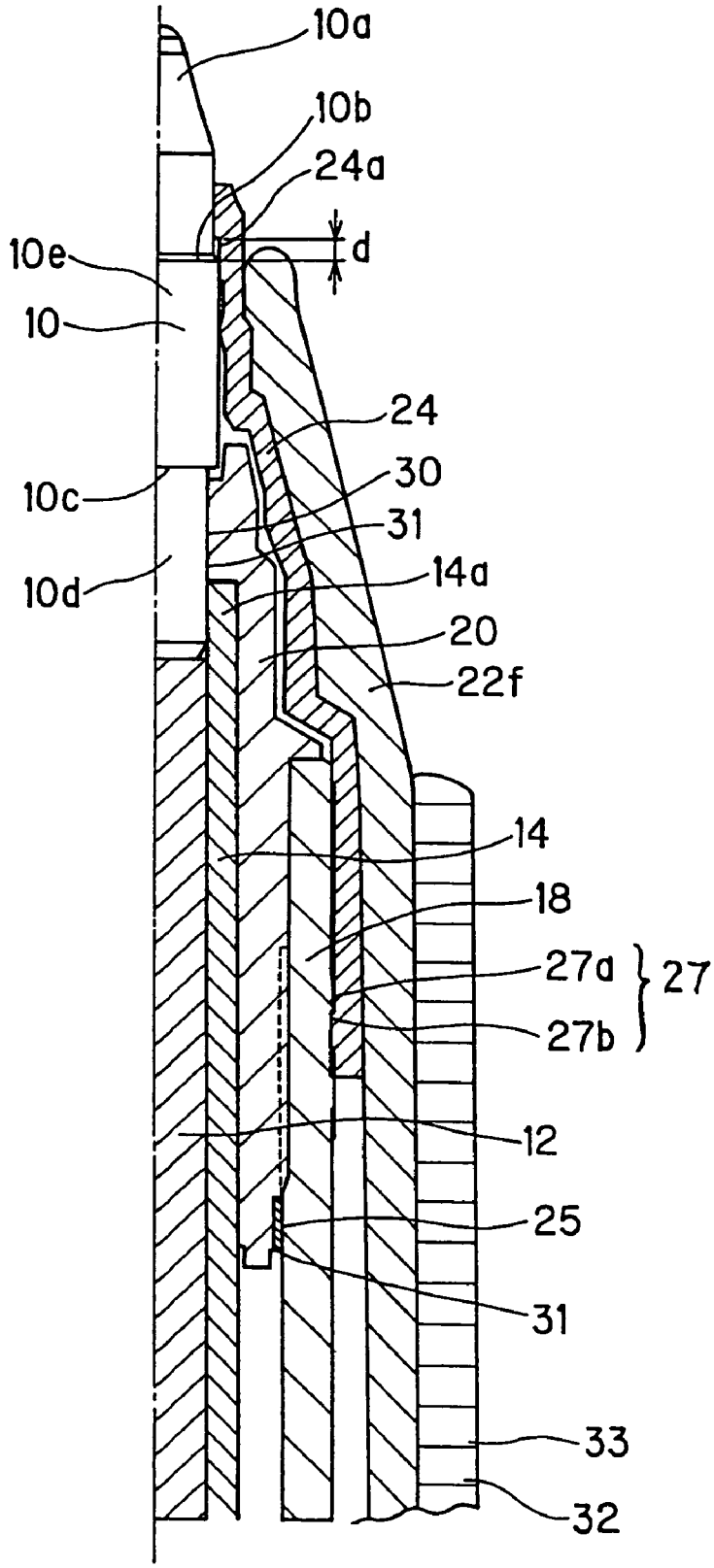
FIG. 2 is a vertical half-sectional illustrative view for explaining a joint member and thereabout in FIG. 1.

Now, joint member 20 and its vicinity will be described in detail. As shown in FIG. 2, in the vicinity of joint member 20, the front peripheral surface that is tapered toward the end of point assembly holder 24 faces the tapered inner peripheral surface of the front part 22*f* of exterior member 22. A step, namely, point assembly abutment 10*b* is formed in writing point assembly 10. Point assembly holder 24 having a stopper portion 24*a* that can abut the point assembly abutment 10*b* to limit forward movement of writing point assembly 10, is arranged at the front side of barrel cylinder 28 (on the writing point assembly 10 side) so as to allow the front end 10*a* of writing point assembly 10 to front to the outside. More detailedly, writing point assembly 24 is engaged with casing cylinder 18 while it covers the joint between writing point assembly 10 and joint member 20 and the joint between casing cylinder 18 and joint member 20 so as to allow the front end 10*a* of writing point assembly 10 to front to the outside. Here, point assembly holder 24 may be engaged with joint member 20. In the case where point assembly holder 24 is engaged with joint member 20, it is preferred that the joined portion between writing point assembly 10 and joint member 20 is covered by point assembly holder 24. If casing cylinder 18 is joined to writing point assembly 10 without provision of joint member 20, it is preferred that the joined area is covered by point assembly holder 24. Provision of such a point assembly holder 24 makes it possible to prevent the writing point assembly from rushing out as a result of compressed gas.

Further, a reduced diametric portion 10*d* having a smaller diameter is formed in the rear of writing point assembly 10. This reduced diametric portion 10*d* borders on a large-diametric portion 10*e* located in front at a step 10*c* and has a smaller diameter than the large-diametric portion 10*e*. Reduced diametric portion 10*d* is not limited to being formed step-wise bordered from the step 10*c*, but can be formed so as to taper or so that the diameter gradually becomes smaller.

The rear end of this reduced diametric portion 10*d* is inserted into and fixed in tube member 14. Of the reduced diametric portion 10*d*, the portion between step 10*c* and the fixed portion of tube member 14 and reduced diametric portion 10*d*, is welded by heating to the front interior periphery (inner periphery of passage hole 30) of joint member 20, so as to keep airtightness. Joining in this way also prevents writing point assembly 10 from dislodging from tube member 14. In a case where no joint member 20 is provided, casing cylinder 18 may be directly jointed to the reduced diametric portion 10*d*.

Joining of joint member 20 or casing cylinder 18 to reduced diametric portion 10*d* provides the following effect.

Generally, it is preferred for a writing instrument that the size of the parts disposed around writing point assembly 10 is smaller (it is preferred that the parts become smaller as they approach the writing point). If a large-diametric part is arranged, the part interferes with the field of view, so that the user cannot have clear vision of the writing point (low visibility) when writing. It is also unpreferable in view of appearance because of the loss of stylishness.

When joint member 20 or casing cylinder 18 is joined, it may be joined to large-diametric portion 10*e*. However, large-diametric portion 10*e* is located closer to the writing point and is also greater in diameter. Therefore, if joined to the large-diametric portion 10*e*, joint member 20 or casing cylinder 18 is positioned closer to the writing point, so that these parts may obstruct the visibility of the writing point when writing. It is also unpreferable in view of appearance because of the loss of stylishness.

Provision of reduced diametric portion 10*d* having a smaller diameter at the rear of writing point assembly 10, fixture of the rear end of the reduced diametric portion 10*d* to tube member 14 and joining of joint member 20 or casing cylinder 18 to the reduced diametric portion 10*d* make the writing point visible and also provide stylishness in appearance.

Further, a metallic ring 25 is provided between joint member 20 and casing cylinder 18, so that the ring 25 is heated by induction heating (electromagnetically) to thereby fuse joint member 20 and casing cylinder 18 and cool them down to achieve joining (welding) to establish airtightness.

A clearance d is provided between engaging portion 24*a* of point assembly holder 24 and point assembly abutment 10*b*. In this embodiment, if joint member 20 and others swell or expand due to moisture absorption, the step or point assembly abutment 10*b* abuts engaging portion 24*a* of point assembly holder 24, causing a risk of point assembly holder 24 coming off. In this case, it is difficult to prevent an accidental rushing of writing point assembly 10 due to compressed gas. To deal with this, in the present embodiment, clearance d is provided aiming at prevention against the above problem resulting from the action of the step or point assembly abutment 10*b* abutting against engaging portion 24*a* of point assembly holder 24. Here, in point assembly holder 24 and casing cylinder 18, point assembly holder rear coupling 27*b* and casing cylinder rear coupling 27*a* are formed respectively, so that these couplings ride and pass over each other to complete engagement.

Though, in the present embodiment joint member 20 and casing cylinder 18 are joined by welding with heat, the rear couplings 27 are disposed at a different position away from the joint (explicitly, at a position to the front of the joint). Here, rear couplings 27 indicate the structures formed on the casing cylinder and joint member for engagement of the point assembly holder, such as point assembly holder rear coupling 27*b* and casing cylinder rear coupling 27*a*. Specifically, these are formed of engaging projections and indentations.

When joint member 20 and casing cylinder 18 are joined together by heat welding, there is a high risk of casing cylinder 18 etc., being thermally deformed. If point assembly holder 24 is engaged at such a place, there are cases where a sufficient strength of engagement cannot be obtained. Arrangement of rear couplings 27 at a position other than the joint provides a high enough coupling strength of point assembly holder 24.

Airtight closure joint sites 31 for keeping the space between the tube member 14 and the casing cylinder 18 airtight are disposed locally around writing point assembly 10.

Figure 4:
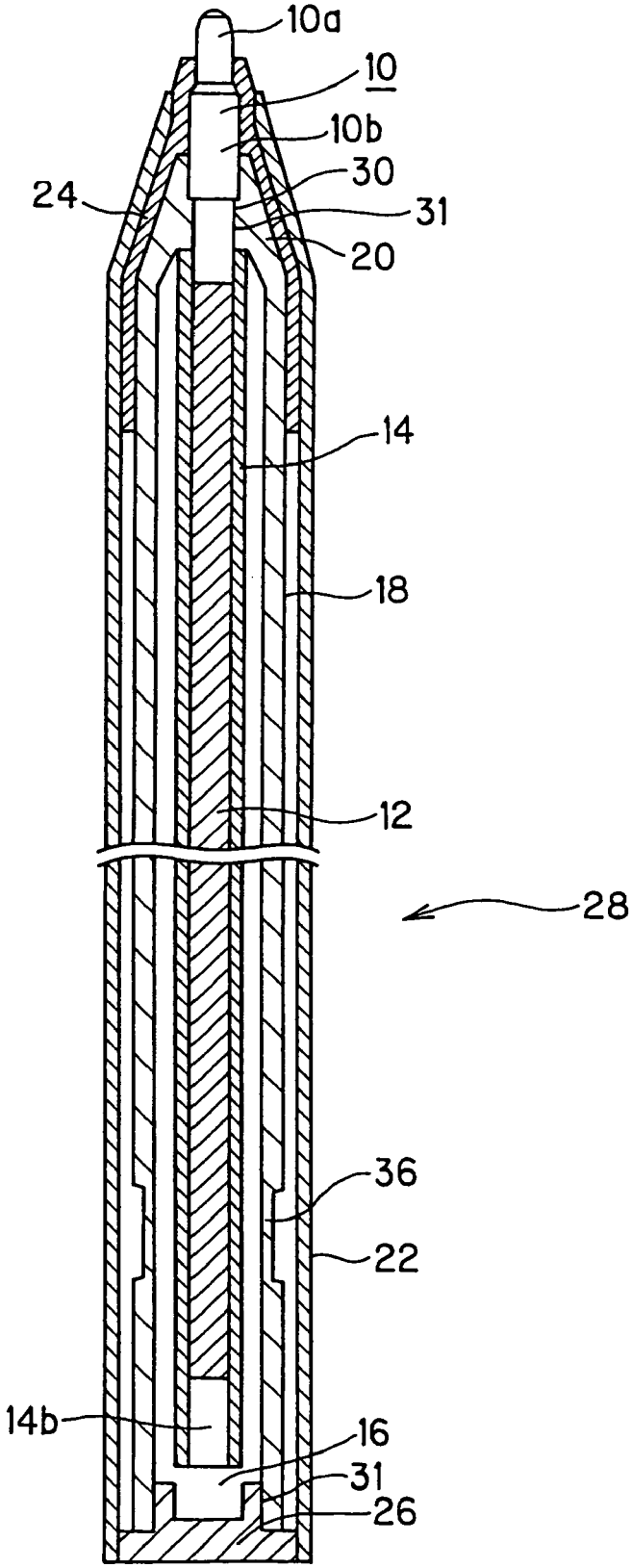
FIG. 4 is a vertical sectional illustrative view showing a gas-pressurized writing instrument to which an embodiment 3 of the present invention is applied.

Here, an 'airtight closure joint site' indicates a place where parts are joined to each other to isolate a space keeping compressed gas from the outside air, such as a place where writing point assembly 10 and casing cylinder 18 joins, a place where writing point assembly 10 and joint member 20 joins, a place where casing cylinder 18 and joint member 20 joins, a place where casing cylinder 18 and a tail plug 26 joins when tail plug 26 is provided at the rear end of casing cylinder 18 as shown in FIG. 4, and the like.

For example, if tail plug 26 or the like is provided at the rear end of casing cylinder 18, an anti-removal measure is needed in order to prevent the tail plug 26 from coming off due to compressed gas. Formation of such joints at multiple places needs respective anti-removal measures, resulting in hindrance against efficient design and increase in cost.

Since writing point assembly 10 is usually formed separately, it necessarily needs to be coupled to another part. This means that the writing point assembly should have at least one joint site. Therefore, if other joint sites are localized around the writing point assembly, provision of the safety means such as anti-removal measures and the like can be also be disposed locally around the writing point assembly only, making it possible to reduce the number of places where anti-removal measures are formed. For example, in the configuration shown in FIG. 1, the part needed for anti-removal measures is point assembly holder 24 while casing cylinder 18 is formed of a one-piece cup-shaped figure to realize anti-removal measures.

Here, point assembly holder 24 may not only be transparent but also be colored to be opaque or translucent. This enables ink smudges inside the writing instrument (the rear part of writing point assembly 10 is principally prone to smudge during assembly) not to be seen from the outside, producing improvement in beauty and appearance quality. Further, opaque or translucent coloring enables color indication. In this case, the color is preferably made to correspond to the color of ink.

It should be noted that casing cylinder 18 may be disposed inside joint member 20. Fixture of joint member 20 as well as fixture between other parts is not limited to fixture by welding, but fitting, bonding and other fixing means can be considered. Also, the joint member may be formed using two-color molding. As an adhesive for bonding, those having sealing performance are preferred, and examples include polyvinyl alcohol solution, two-part epoxy, hot melt and others. When bonding is used, in order to secure the necessary gas barrier performance, bonding is made in combination with undercut sealing (fitting). It should be noted that it is very difficult to select an adhesive that has both sealing performance and adhesiveness. Therefore, it is preferred that joining be done by welding.

Covered around the periphery of casing cylinder 18 and point assembly holder 24 is a moisture-proof exterior member 22. This exterior member 22 is formed of front and rear parts (front part 22*f* and rear part 22*r*). These parts encloses casing cylinder 18 and are integrated by screw fitting, crimping or bonding at the joint 22*b*. It is advantageous, if possible, that the joint 22*b* is sealed.

Production of gas-pressurized writing instruments can be made by forming casing cylinder 18 and others with a material presenting low gas permeability or gas impermeability. However, most of such materials that present low gas permeability or gas impermeability (e.g., ethylene vinyl alcohol copolymer (EVOH), polyvinyl alcohol (PVA), polyacryl nitrile (PAN), nylon) tend to increase gas permeability or permit gas to permeate therethrough as the ambient relative humidity increases. For example, ethylene vinyl alcohol copolymer (EVOH) presents a very high barrier performance when dried. However, as the relative humidity increases, the barrier performance lowers. Covering the periphery of the tube member or/and casing cylinder with moisture-proof exterior member 22 can prevent reduction in barrier performance. Concerning the extent the exterior member 22 covers, it is most preferred that the whole of the material that presents low gas permeability or gas impermeability is covered, but part of the material may be covered. If partially covered, preferably the area the user's hand comes into touch with, most preferably the holding portion (grip portion 32) should be covered.

Here, the exterior member 22 may be formed in a hermetic structure so as to isolate the interior from ambient air. This makes it possible to improve thermal resistance and moisture resistance. The hermetic structure can be formed by joining (by fitting, bonding, welding or other methods) exterior member 22 with casing cylinder 18, point assembly holder 24, joint member 20, tail plug 26 and the like.

Exterior member 22 should have greater thermal resistance or/and moisture resistance than that of casing cylinder 18. In making choice of a low gas permeable or gas impermeable resin to be used for casing cylinder 18 from various resin materials, it is necessary to consider the influence of user's handsweat on the barrel when the user holds the writing instrument and writes with it. It is also necessary to consider a situation in which the writing instrument heats up as it is left on the top of the dashboard of an automobile. However, it is difficult to make choice of a resin material which meets the requirements of both low gas permeability and thermal resistance and moisture resistance. It is not so necessary to consider thermal resistance and moisture resistance when making choice of a material for casing cylinder 18 into which gas will be sealed, from various resin materials presenting low gas permeability or gas impermeability, if exterior member 22 presents the necessary thermal resistance or moisture resistance. Thereby, the range of selection of the resin can be made wider and the functionality can be improved. Preferred examples of the resin to be used for exterior member 22 include polypropylene (PP), polyethylene (PE), polyolefin, cyclic polyolefin, polyethylene terephthalate (PET), polyethylene naphthalate (PEN), vinylidene chloride. Particularly, when the casing cylinder is formed of ethylene vinyl alcohol copolymer (EVOH), polypropylene (PP) and polyethylene (PE) resins are preferably used because these are excellent in thermal resistance, rigidity and adhesiveness. Further, it is also possible to enhance the moisture resistance and the interior visibility (light transmittance) for permitting easy monitoring of the remaining amount of ink therein while keeping up the gas barrier effect.

Though the exterior member 22 has a barrel cylinder structure, separated from casing cylinder 18 (when exterior member 22 is given as a constituent of barrel cylinder 28), the exterior member 22 is not necessarily separated from casing cylinder 18, but exterior member 22 can be formed (by two-color molding, deposition, laminating or other methods) so that it integrally covers the casing cylinder 18 only or the whole part other than the front end 10*a* of writing point assembly 10.

Further, the wall of grip portion 32 of exterior member 22 at which the user holds, is made thicker than the other part of exterior member 22. The grip portion 32 that the user holds is most affected by handsweat of the user. If the wall thickness of this part is made greater than the other part of the exterior member, it functions to lessen the influence on the casing cylinder 18 inside the exterior member. Enlargement of the wall thickness can be performed by not only merely increasing the wall thickness but also by attaching a grip 33 as a separate part as in the embodiment shown in FIG. 1.

Further, when the writing instrument is heated for incineration or the like, the casing cylinder 18 and exterior member 22 break up first (casing cylinder 18 and exterior member 22 break up before writing point assembly 10 displaces from the joint portion), so that the sealed gas will be released to the outside of the aforementioned space. The term "breakup" in this description indicates fusion, generation of breakage and cracks, formation of a hole, disconnection of a joint if any. Since a breakup occurs first to discharge out the compressed gas, the pressure acting on writing point assembly 10 can be reduced, thus making it possible to reduce the risk of writing point assembly 10 bursting (rushing out).

In this case, point assembly holder 24 is preferably formed of a material having greater thermal resistance than casing cylinder 18. Preferred examples include polypropylene (PP), polyethylene (PE), polybutylene terephthalate (PBT), cyclic polyolefin, polyethylene terephthalate (PET), polyoxymethylene (POM), polyethylene naphthalate (PEN) and polyvinyl chloride.

As the material for the casing cylinder 18 and joint member 20, materials that present low gas permeability or gas impermeability, for example, ethylene vinyl alcohol copolymer (EVOH), nylon, transparent nylon and polyethylene terephthalate (PET) can be used. In particular, ethylene vinyl alcohol copolymer (EVOH) is preferred. The reason will be described later.

Because point assembly holder 24 serving as anti-removal for the writing point assembly 10 is provided and because the rigidity of casing cylinder 18 drops at a predetermined temperature even under incineration after its life, so that gas leak occurs to release gas pressure inside space 16, there is no risk of writing point assembly 10 rushing out from the front of the writing instrument or the refill.

The compressed gas to be sealed in the space 16 may employ nitrogen ($N_2$) gas or air. Dry nitrogen gas or dry air having a humidity of 60% (at 25 deg. C.) or lower is preferably used.

The volume of space 16 provided between tube member 14 and casing cylinder 18 is adjusted to be 2 to 10 times the volume of ink initially stored in tube member 14, and the pressure inside the space 16 when almost all ink has been consumed at just before the end of writing life is adjusted to be 0.15 MPa to 0.6 MPa.

The reason the compressed gas volume relative to the ink volume is specified to be 2 to 10 times is that, if the volume of the compressed gas is lower than 2 times of the ink volume, it is impossible to obtain a sufficient pressure that forces ink out due to reduction of the ink volume when ink is used up by writing, and that the difference of the pressure at the life end from the initial pressure is too large, or the change in pressure is too large. On the contrary, if the ratio is set to be greater than 10 times, wasteful space is needed, resulting in increase in cost and giving rise to an appearance problem that the amount of ink is perceived to be relatively low.

The reason the pressure inside the space 16 at the ink end when almost all ink has been used up is specified to be 0.15 MPa to 0.6 MPa is that, with a pressure lower than 0.15 MPa, it is difficult to obtain a smooth write feeling for lack of pressure to drive ink out, water is prone to enter into writing point assembly 10 when writing is performed on a wet sheet of paper or the like, and water is prone to penetrate into writing point assembly 10 when the writing instrument drops into water. On the other hand, with a pressure greater than 0.6 MPa, it is difficult to prevent ink leakage from the writing point.

It is preferred that ink will not touch the casing cylinder 18 or/and joint member 20. In this case, it is possible to make the choice of a material without consideration of the ink resistance of the casing cylinder or/and joint member 20. Here, the above mentioned condition "ink will not touch casing cylinder 18 or/and joint member 20" not only means that ink will never touch casing cylinder 18 or/and joint member 20, but also includes the case where a small amount of ink adheres thereto. For example, there are cases where ink adheres to casing cylinder 18 and joint member 20 in the manufacture of a writing instrument. Such a state of adherence should also be considered as a case of "ink will not touch casing cylinder 18 or/and joint member 20".

It is also preferred that at least part of the tube member 14 and casing cylinder 18 is formed of a transparent or translucent resin, in view of easy monitoring of the remaining ink. Further, for the same reason, at least part of exterior member 22 and point assembly holder 24 may also be formed to be transparent or translucent.

Writing point assembly 10, tube member 14, casing cylinder 18 may be integrated so as to provide a refill which is detachably fitted into barrel cylinder 28 of a writing instrument.

Further, writing point assembly 10, tube member 14, casing cylinder 18 and exterior member 22 may be integrated into a refill.

Embodiment 2

Figure 3:
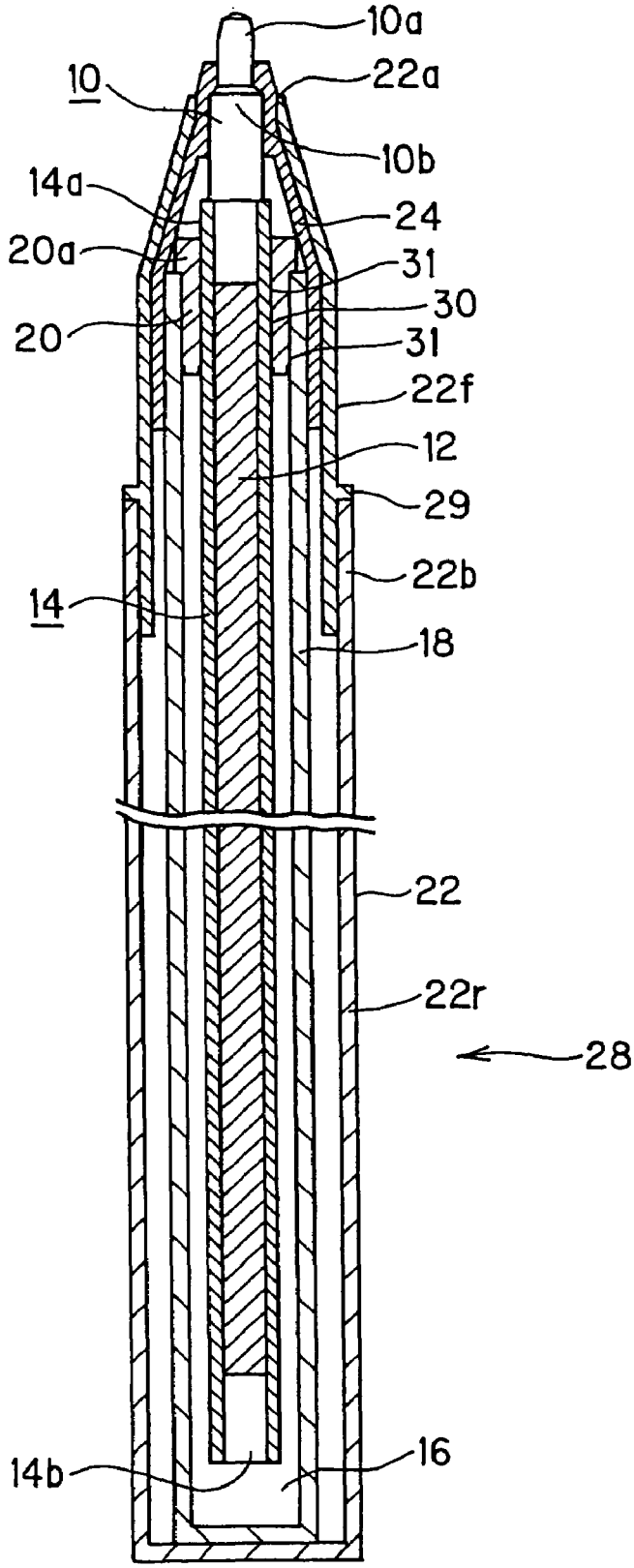
FIG. 3 is a vertical sectional illustrative view showing a gas-pressurized writing instrument to which an embodiment 2 of the present invention is applied.

FIG. 3 shows an embodiment 2 of a variational example in which the shape of joint member 20 is modified. In embodiment 2, joint member 20 is joined to tube member 14 and casing cylinder 18 so that most of tube member 14 is included in casing cylinder 18.

Figure 11:
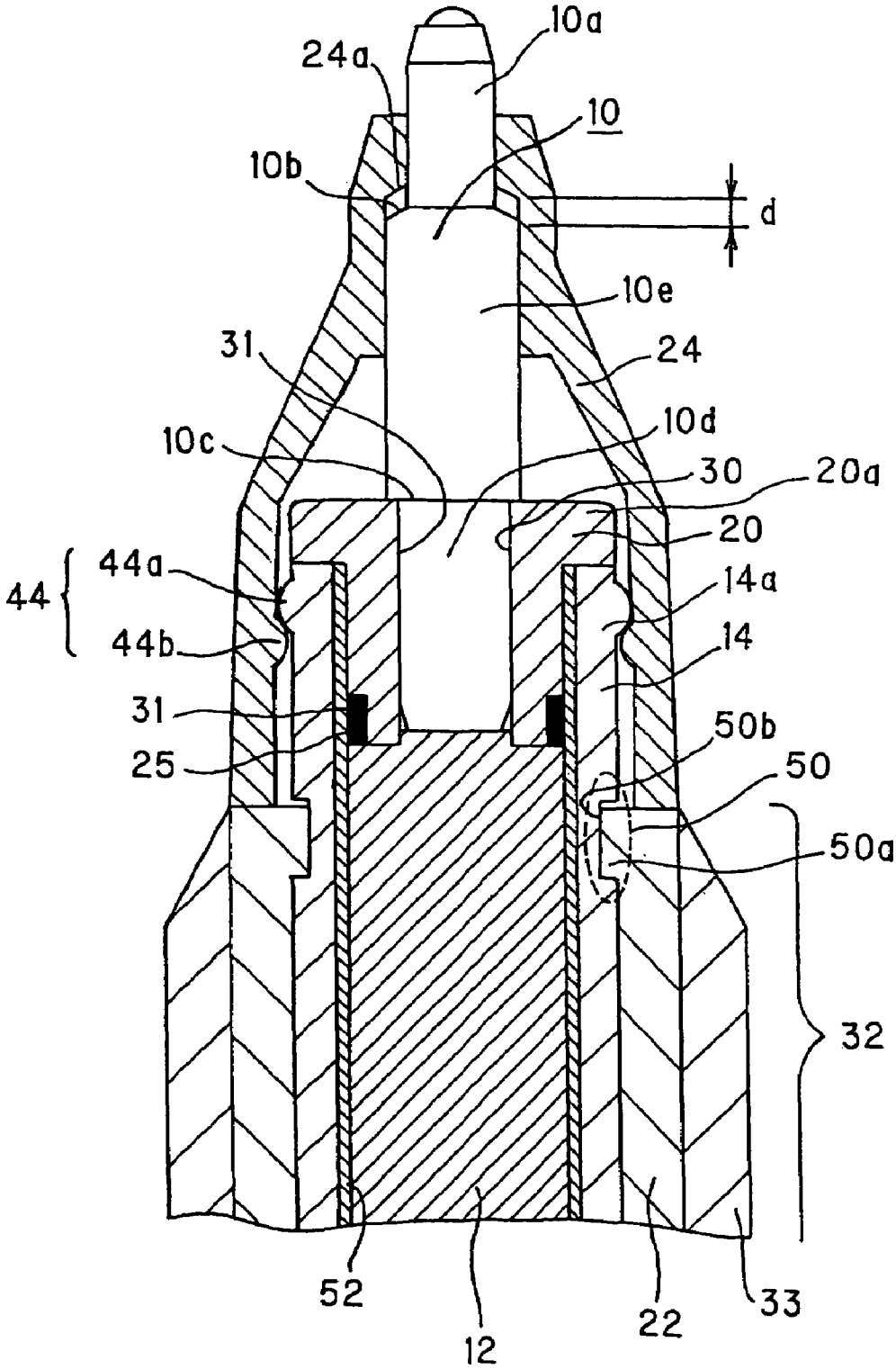
FIG. 11 is a vertical sectional illustrative view for explaining the essential part of a joint member and thereabout of the gas-pressurized writing instrument of FIG. 10.

When a resin material other than that presenting low gas permeability or gas impermeability is used for tube member 14, it is preferred that the front end of tube member 14 is covered by a point assembly holder 24 that is formed of a low gas permeable or gas impermeable resin material, in order to prevent gas permeation from casing cylinder 18 through tube member 14. Detailedly, point assembly holder 24 is joined to writing point assembly 10 and casing cylinder 18 (heat welding, ultrasonic welding, bonding, etc., can be used as the joining method) to thereby prevent compressed gas leakage. When a resin material that presents low gas permeability or gas impermeability is used for tube 14, point assembly holder 24 does not necessarily employ resin material having low gas permeability or gas impermeability and does not necessarily need joining such as welding and the like. In this case, a configuration in which a moisture-proof layer is formed on the inner peripheral surface of tube member 14 as shown in FIG. 11 is preferred. The other configuration is basically the same as embodiment 1 of FIG. 1.

Embodiment 3

FIG. 4 shows an embodiment 3 in which a joint member 20 is extended to the rear and integrally formed with a casing cylinder 18 while a tail plug 26 is joined (fitted) to casing cylinder 18 and exterior member 22. Casing cylinder 18 and joint member 20 may be combined with another part such as tail plug 26 etc., or may be partially interposed with another part. Tail plug 26 in this case, however, needs to have low gas permeability or gas impermeability (gas barrier property) except the case where an aftermentioned gas barrier layer or the like is provided. Further, it is preferred that welding or any other anti-burst (rushing out) measure is adopted.

In this embodiment, the casing cylinder 18 and writing point assembly 10 are joined so as to enclose the whole of tube member 14 within casing cylinder 18 and hence keep tube member 14 out of contact with the external air. Because tube member 14 is kept out of contact with the external air, it may use a material that is permeable by compressed gas. Therefore, it is possible to broaden the variation of material choice of tube member 14, so that various types of materials such as materials that are highly transparent, are easy to form and have high clear drain performance and others can be used.

While integral forming of joint member 20 and casing cylinder 18 as stated above reduces the number of parts, provision of tail plug 26 at the rear end of casing cylinder 18 to allow insertion of tube member 14 from the rear negates the reduction of the number of parts. Nevertheless, this arrangement enables choice and design of easily formable parts, hence reduces the total cost as well as minimizing the size and improving the transparency.

Casing cylinder 18 shown herein is configured of two parts being joined together, in such a manner that the joint is formed with a lower joining strength than that of a joint with writing point assembly 10. Examples of the joints with writing point assembly 10 may include that between writing point assembly 10 and tube member 14, that between writing point assembly 10 and point assembly holder 24 and that between writing point assembly 10 and casing cylinder 18. In this embodiment, joints having a joining strength smaller than these joints are formed. Such a joint may be one where tail plug 26 is provided for casing cylinder 18 or tube member 14, one where casing cylinder 18 is formed of two parts, or one where a hole is formed in casing cylinder 18 and is joined with a part that fills that hole. It is also possible to consider a configuration where a hole of casing cylinder 18 is filled up with an adhesive or resin. As a method of making difference in joining strength, for example, changing the amount of adhesive, changing the deformed amount when fitting, differentiating the size of the joining area and other methods can be considered. The present embodiment 3 shows a configuration where tail plug 26 is provided at the rear of casing cylinder 18. Joining strength between tail plug 26 and casing cylinder 18 is set to be smaller than the joining strength at the joint between writing point assembly 10 and casing cylinder 18. Thus, this setting causes any other joint than that with writing point assembly 10 to break away so as to discharge the compressed gas outside even if the gas-pressurized writing instrument is heated. As a result, it is possible to reduce the pressure acting on writing point assembly 10 and reduce the risk of writing point assembly 10 bursting and/or ink 12 surging out due to pressure. Here, the joining strength is measured by applying a tensile force in the axial direction to the joint.

Here, for example, in a case, as in embodiment 1 shown with FIG. 1, where joint member 20 is provided between casing cylinder 18 and writing point assembly 10, a joint formed with a joining force smaller than the minor strength of the joining strength at the joint between writing point assembly 10 and joint member 20 and the joining strength at the joint between casing cylinder 18 and joint member 20 may be formed.

Examples of "the joint formed with a smaller joining strength" include, as stated above, one where tail plug 26 is provided for casing cylinder 18 or tube member 14, one where casing cylinder 18 is formed of two parts, or one where a hole is formed in casing cylinder 18 and is joined with a part that fills that hole. It is also possible to consider a configuration where a hole of casing cylinder 18 is filled up with an adhesive or resin. As the method of making difference in joining strength, for example, changing the amount of adhesive, changing the deformed amount when fitting, differentiating the size of the joining area and other methods can be considered. It is further possible that casing cylinder 18 is formed of two parts. For that method, one whereby tail plug 26 is provided for casing cylinder 18 or tube member 14, one whereby casing cylinder 18 is formed of two parts and these two parts are joined together, or one whereby a hole is formed in casing cylinder 18 and is joined with a part that fills that hole, can be considered.

Provision of a joint formed with a joining force smaller than the minor strength of the joining strength at the joint between writing point assembly 10 and joint member 20 and the joining strength at the joint between casing cylinder 18 and joint member 20, makes it possible to cause any other joint than the joint between the writing point assembly and joint member and the joint between casing cylinder and joint member to break away so as to discharge the compressed gas outside even if the gas-pressurized writing instrument is heated. Therefore, it is possible to reduce the pressure acting on the writing point assembly and reduce the risk of writing point assembly 10 bursting and/or ink 12 surging out due to pressure.

When there are multiple joints, it is preferred that the joining strength at the joint with writing point assembly 10 (for example, the joint between the writing point assembly 10 and joint member 20 or the joint between the writing point assembly 10 and casing cylinder 18) is set at the greatest. This is because the joint with writing point assembly 10 is prone to weaken due to the constant load from writing and hence prone to burst out (rush out).

As stated above, when the casing cylinder 18 is adapted to break up first, when a joint with a smaller joining strength than that at the joint with the writing point assembly is provided, and when a joint formed with a joining force smaller than the minor strength of the joining strength at the joint between the writing point assembly and the joint member and the joining strength at the joint between the casing cylinder and the joint member is formed, the material for the casing cylinder (including a tail plug etc.) is preferably ethylene vinyl alcohol copolymer (EVOH).

In some cases, the temperature in storehouses for storage of writing instruments may reach 50 deg. C. to 70 deg. C. If the casing cylinder or other parts will break away in this temperature range, such an article is unmarketable. Ethylene vinyl alcohol copolymer (EVOH) will not decompose in the above temperature range, and starts decomposing at a predetermined temperature above 90 deg. C., which is in excess of the above temperature range. Therefore, this copolymer enables easy storage and will easily decompose if put under incineration providing the effect of discharging the compressed gas outside. The copolymer also has a low gas permeability, providing the function of hardly permitting a gas to permeate therethrough to the outside in an ordinary state. Other material examples are, nylon, transparent nylon, polyethylene terephthalate (PET), polyethylene naphthalate (PEN), polybutylene terephthalate (PBT) and polyacryl nitrile (PAN).

Alternatively, a thin-wall portion 36 may be formed at a part (the outer periphery in the drawing) of casing cylinder 18. Also, a thin-wall portion 36 may be formed at the bottom of casing cylinder 18, as will be shown in embodiment 4 with FIG. 5. All these configurations enable the thin-wall portion 36 to break first so that the compressed gas will be smoothly discharged out when heated under incineration or the like. The other configuration is basically the same as embodiment 1.

Embodiment 4 and Embodiment 7

Figure 5:
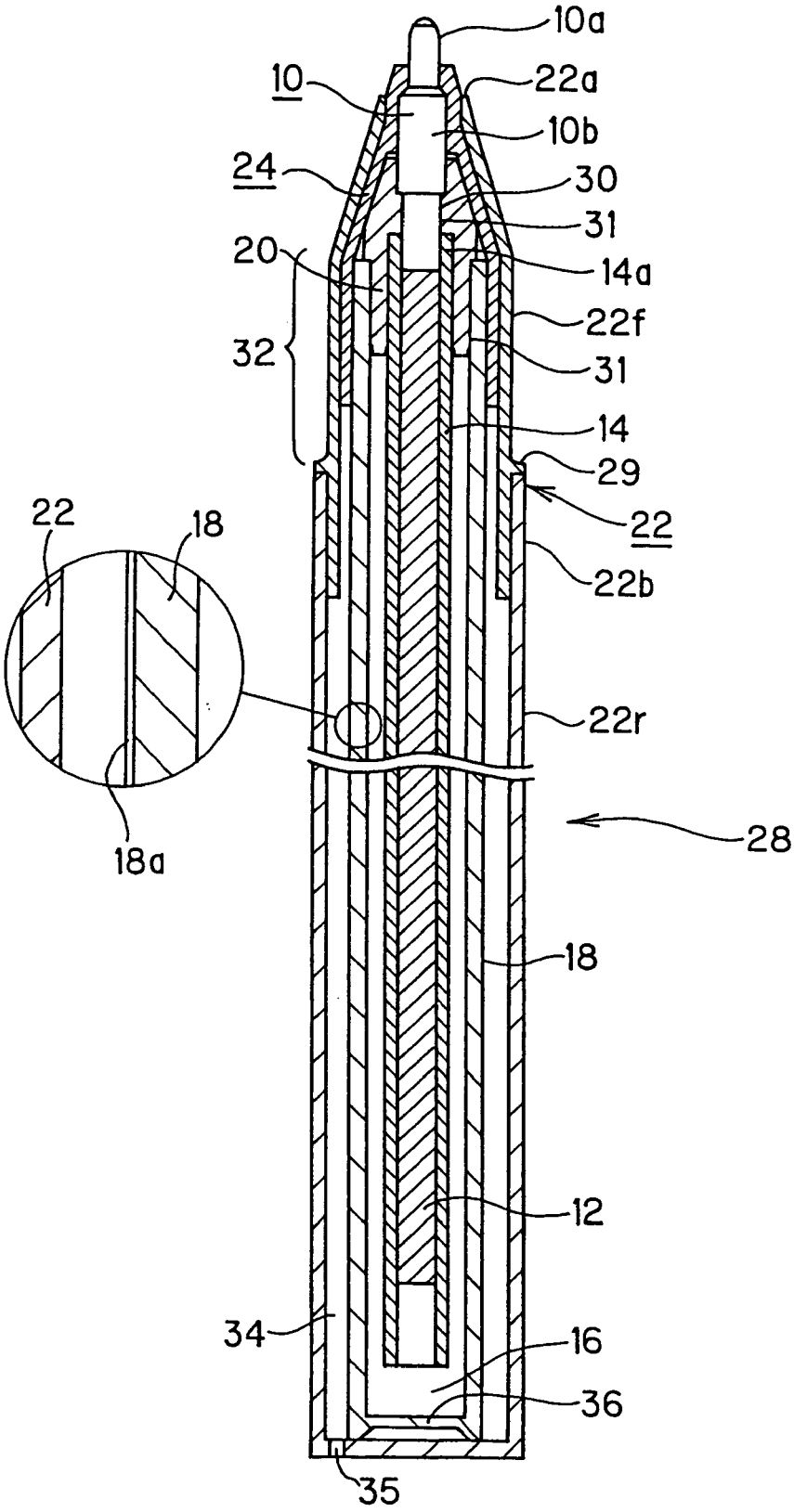
FIG. 5 is a vertical sectional illustrative view showing a gas-pressurized writing instrument to which an embodiment 4 of the present invention is applied.

FIG. 5 shows an embodiment 4 of a gas-pressurized writing instrument in which a moisture-proof layer **18*a* is integrally formed on the outer surface of casing cylinder 18 and the outer surface of joint member 20 by fusion bonding using two-color molding. In this embodiment, moisture-proof layer 18*a* is formed on the entire outer surface of these. In this case, since moisture-proof layer 18*a* provides part of the function of exterior member 22, exterior member 22** becomes an optional component.

Moisture-proof layer **18*a* does not need to be formed on the whole surface, but is preferably formed in, at least, the areas exposed and in contact with the external air. When partially formed, moisture-proof layer 18*a* is preferably formed in a grip portion 32** which is held by the hand and fingers.

As the material for moisture-proof layer **18*a* formed on the outer surface of the casing cylinder 18**, polypropylene (PP), polyethylene (PE), polyethylene terephthalate (PET), polybutylene terephthalate (PBT), modified polyphenylene ether (m.PPE), cyclic polyolefin, vinylidene chloride, paraffin and the like can be used for improvement of moisture-proof performance. Polypropylene (PP) and polyethylene (PE) are particularly preferred for two-color molding. When the casing cylinder is formed of ethylene vinyl alcohol copolymer (EVOH), polypropylene (PP) and polyethylene (PE) resin are preferably used. This is because it is possible to enhance the moisture resistance and the interior visibility (light transmittance) for permitting easy monitoring of the remaining amount of ink therein while keeping up the gas barrier effect. Further, it is because these are also excellent in thermal resistance, rigidity and adhesiveness.

Concerning two-color molding of moisture-proof layer **18*a*, when a separate joint member 20 is fitted to or joined to casing cylinder 18, it is necessary to form a moisture-proof layer by two-color molding for each of elements 18 and 20, except the case where point assembly holder 24 and exterior member 22 are provided with a moisture-proof function. As in embodiment 3 shown in FIG. 4 in which joint member 20 is extended rearwards forming an integrated configuration with casing cylinder 18, it is possible to implement two-color molding of moisture-proof layer 18***a* over the outer surface, all at once. Therefore, it is possible to reduce the number of assembly steps and create a perfect hermetic state.

The suitable thickness of moisture-proof layer 18*a* is 0.2 to 2.0 mm. If thinner than 0.2 mm, it presents poor moisture resistance and formability. If thicker than 2.0 mm, the barrel is too thick in diameter, causing uncomfortable feeling in use and presenting poor transparency. Preferably, the thickness is 0.4 to 1.0 mm and more preferably 0.5 to 0.8 mm.

Though it is inherently desirable to provide a hermetic configuration, it is also possible to create a clearance 34 between the exterior member 22 and casing cylinder 18 and provide a vent hole 35 communicating with the outside for exterior member 22 so that the clearance 34 communicates with the outside via vent hole 35. As a method of forming clearance 34, a groove may be formed on the inner surface of exterior member 22 or the outer surface of casing cylinder 18. In the present invention, provision of clearance 34 between the exterior member 22 and casing cylinder 18 in combination with provision of vent hole 35 that communicates with the outside for exterior member 22 enables smooth discharge of the compressed air leaking out when casing cylinder 18 is broken up or for any other reason, hence prevents rush and other actions of writing point assembly 10 and ink 12.

The vent hole 35 is formed near the rear end of exterior member 22. Since vent hole 35 is arranged at the rear end of exterior member 22 opposite to the joint with writing point assembly 10, it is possible to minimize the pressure acting on the front where writing point assembly 10 is located. It should be noted that exterior member 22 may also be formed of a material that will decompose at a predetermined temperature. The other configuration is basically the same as embodiment 1.

Figure 9:
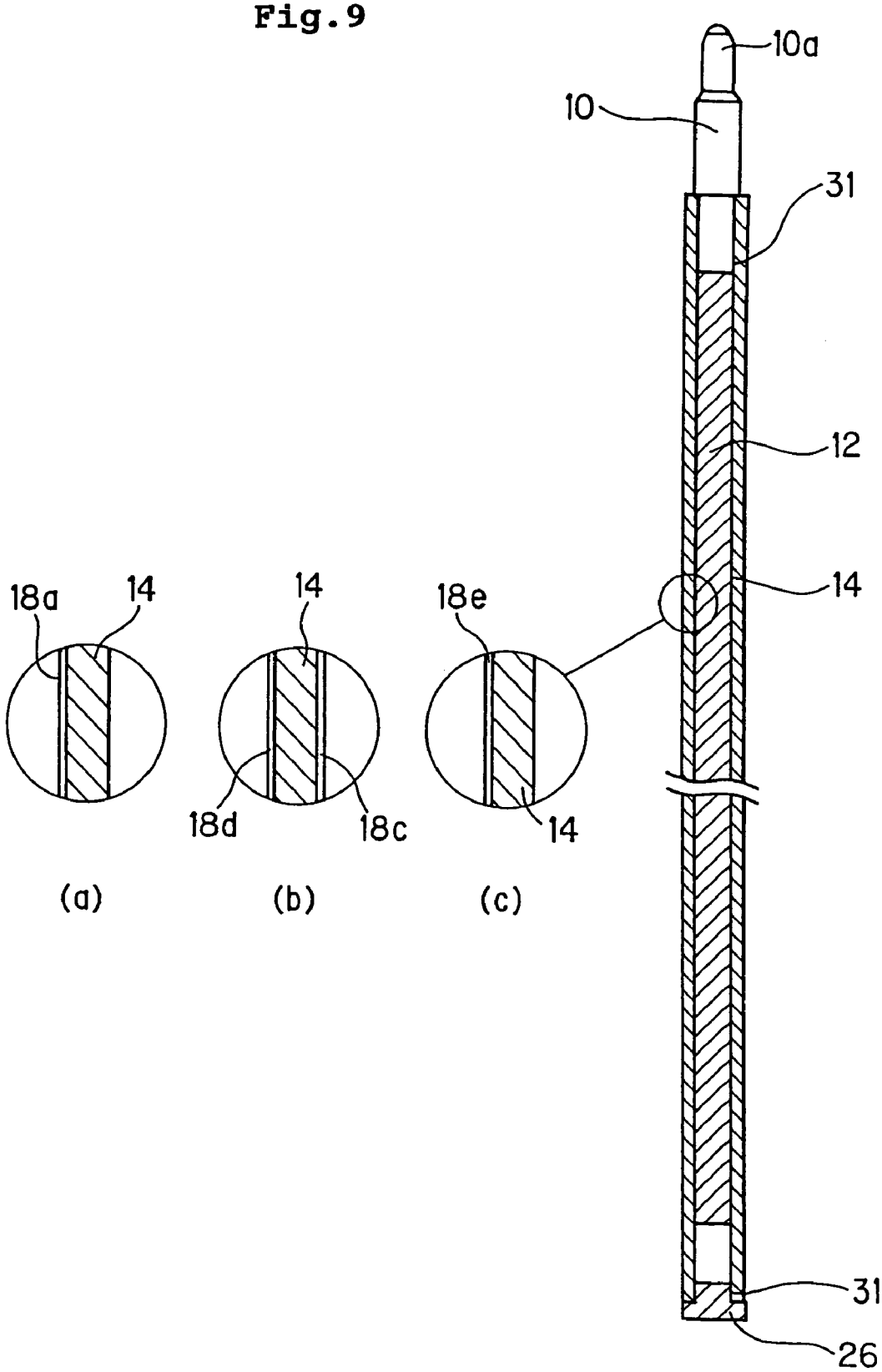
FIG. 9(*a*) is a vertical sectional illustrative view showing a gas-pressurized writing instrument to which an embodiment 7 of the present invention is applied, FIG. 9(*b*) a gas-pressurized writing instrument to which an embodiment 8 of the present invention is applied, and FIG. 9(*c*) a gas-pressurized writing instrument to which an embodiment 9 of the present invention is applied.

Furthermore, in a gas-pressurized writing instrument including: a tube member 14 which is made of a material that presents low gas permeability or gas impermeability, has a writing point assembly 10 at the front end thereof and is closed at the rear end to store ink 12 therein to be fed to the writing point assembly 10; and a compressed gas sealed in the tube member 14, a moisture-proof layer 18*a* may be integrally formed in the same manner as above by two-color molding on, at least, part of the outer surface of the tube member 14. An embodiment 7 realizing this structure is shown in FIG. 9(*a*). The moisture-proof layer may be provided either in the area on the outer surface in contact with the exterior air or as a whole. Tube member 14 of each configuration shown in FIG. 9 can be formed with the aforementioned exterior member 22.

Embodiment 5 and Embodiment 8

Figure 6:
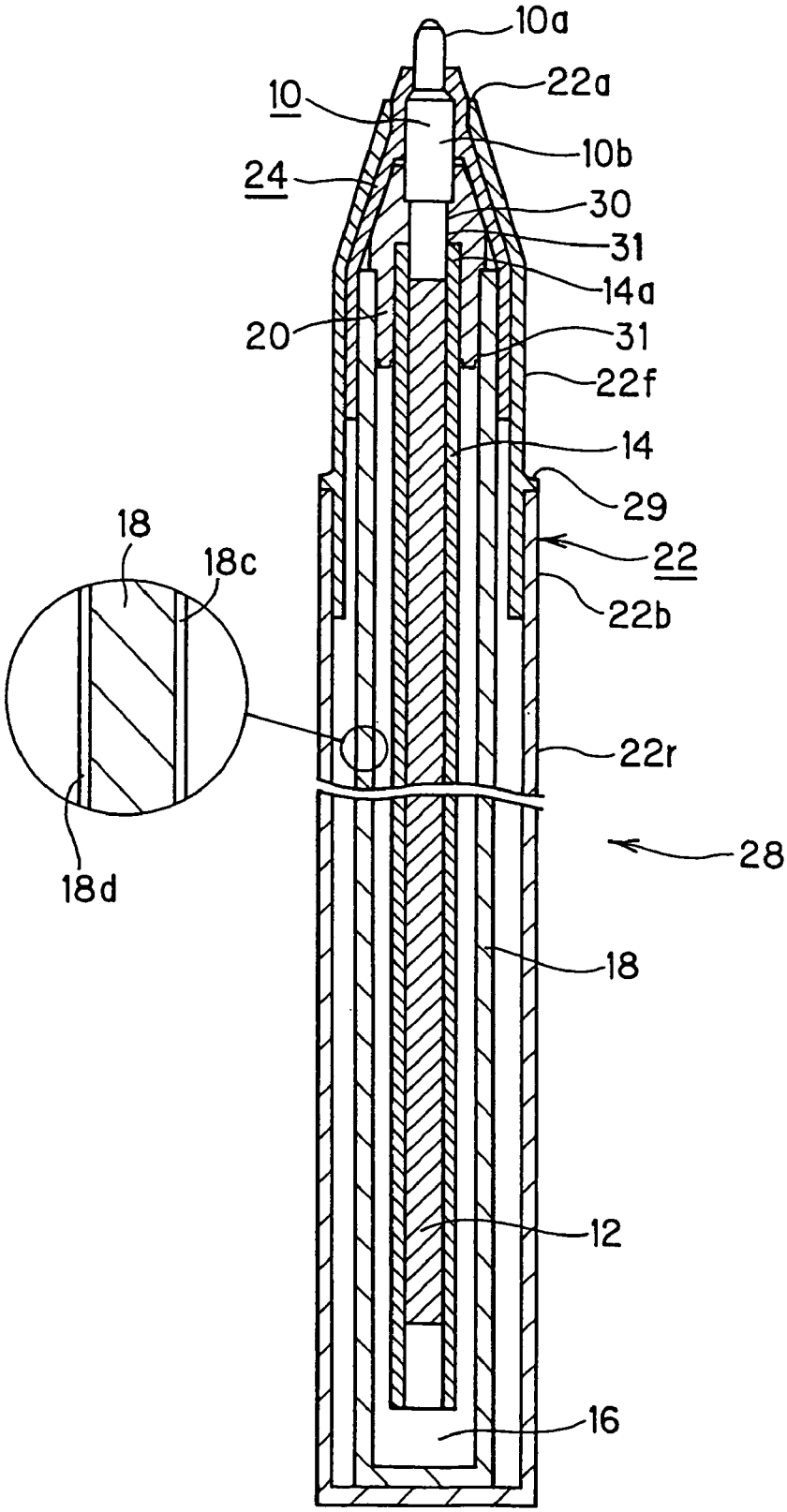
FIG. 6 is a vertical sectional illustrative view showing a gas-pressurized writing instrument to which an embodiment 5 of the present invention is applied.

FIG. 6 shows an embodiment 5, in which the inner surface or the outer surface of casing cylinder 18 is formed with a gas barrier layer 18*c* or 18*d* made of a material that presents low gas permeability or gas impermeability. In the present embodiment, the inner surface is formed with a gas barrier layer 18*c* and the outer surface with a gas barrier layer 18*d*.

Here, gas barrier layers 18*c* and 18*d* formed on the inner and outer surfaces of casing cylinder 18 can employ a material such as ethylene vinyl alcohol copolymer (EVOH), polybutylene terephthalate (PBT), polyethylene terephthalate (PET), polyoxymethylene (POM), nylon, polyethylene naphthalate (PEN), polyacryl nitrile (PAN) and the like. Use of ethylene vinyl alcohol copolymer (EVOH) for the material for gas barrier layers 18*c* and 18*d* is preferable because the gas barrier performance is excellent and the formability is also good. If this copolymer is used in combination with another material, the proportion is preferably at least equal to or 50% or greater (less than 100%). This is because if the amount is less than 50%, it is difficult to keep the necessary gas barrier performance.

The casing cylinder 18 may be formed of any of polyethylene terephthalate (PET), nylon, polyethylene naphthalate (PEN) and polybutylene terephthalate (PBT), which all present medium gas barrier performance. Casing cylinder 18 formed of any of these material may be formed with gas barrier layers 18*c* and 18*d* of ethylene vinyl alcohol copolymer (EVOH).

With any of the above materials, it is possible to further improve the gas barrier performance. Further, use of polyethylene terephthalate (PET) can offer improved moisture resistance and also cost reduction. Use of nylon can offer improved formability and cost reduction. Use of polyethylene naphthalate (PEN) can offer improved transparency and water resistance. Use of polybutylene terephthalate (PBT) can offer good formability and cost reduction.

Gas barrier layers 18*c* and 18*d* are preferably formed to be thin in view of securing the interior visibility of ink, and can be formed in casing cylinder 18 by various methods such as printing, transfer, deposition, coating and the like. It is also possible to provide a moisture-proof layer over gas barrier layer 18*d* on the outer surface.

The suitable thickness of these gas barrier layers (18*c*, 18*d*) is 1 μm to 2.0 mm. If thinner than 1 μm, it presents a poor gas barrier performance. If thicker than 2.0 mm, it costs too much and presents poor transparency. Preferably, the thickness is 0.1 mm to 1.0 mm, more preferably 0.4 mm to 0.8 mm.

For forming casing cylinder 18 as a substrate, various kinds of resins other than the above can be used. For example, polypropylene (PP), polyethylene (PE), etc., having high moisture resistance can be employed. Further, if a gas barrier layer 18*c* is formed on the inner surface of casing cylinder 18, it is possible to obtain a moisture-proof effect from casing cylinder 18 and a gas barrier effect from gas barrier layer 18*c* on the inner surface, so that both the moisture-proof effect and the gas barrier effect can be realized by casing cylinder 18 only. In this way, the gas barrier layer is more effective, when formed on the inner surface 18*c* than on the outer peripheral surface 18*d*, in preventing degradation of the gas barrier function because it will not be exposed to the external air (in particular, it is more effective when the compressed gas is nitrogen gas because no oxygen gas is included).

It is also preferred that a moisture-proof layer is formed on the inner and/or outer surfaces of joint member 20, and the same effect can be obtained as when a gas barrier layer is provided for casing cylinder 18.

For the material used for the gas barrier layer of the joint member 20, similarly to the above, ethylene vinyl alcohol copolymer (EVOH), polybutylene terephthalate (PBT), polyethylene terephthalate (PET), polyoxymethylene (POM), nylon and the like can be considered. For the joint member 20 itself forming the substrate, various resins (polypropylene (PP), polyethylene (PE) etc.) can be used.

When casing cylinder 18 and joint member 20 are integrally formed, the gas barrier layer can be formed at once, hence it is possible to reduce the number of steps and simplify the formation of the gas barrier layer compared to the case where the gas barrier layers are formed separately.

In addition, since there is no joint between joint member 20 and casing cylinder 18, improved gas barrier performance can be obtained.

Though the gas barrier layer may be formed partly, it is preferred that the layer is formed entirely in order to obtain long-term effect of prevention against gas leakage. The gas barrier layer is effective if it is formed either on the inner or outer surface of casing cylinder 18. Yet, it is preferred that the gas barrier layer is formed on both sides in order to obtain long-term effect of prevention against gas leakage. The other configuration is basically the same as the embodiment 1 shown in FIG. 1.

Furthermore, in a gas-pressurized writing instrument including: a tube member 14 which has a writing point assembly 10 at the front end thereof and is closed at the rear end to store ink 12 therein to be fed to the writing point assembly 10; and a compressed gas sealed in the tube member 14, a gas barrier layer that presents low gas permeability or gas impermeability is formed on, at least part of the inner surface or outer surface of the tube member 14 as in embodiment 8 shown in FIG. 9(*b*). This gas barrier layer may be formed on both the inner and outer surfaces. It is also possible to provide it in the area in contact with exterior air only. Alternatively, it may be formed in entirety.

Embodiments 6 and 9

Figure 7:
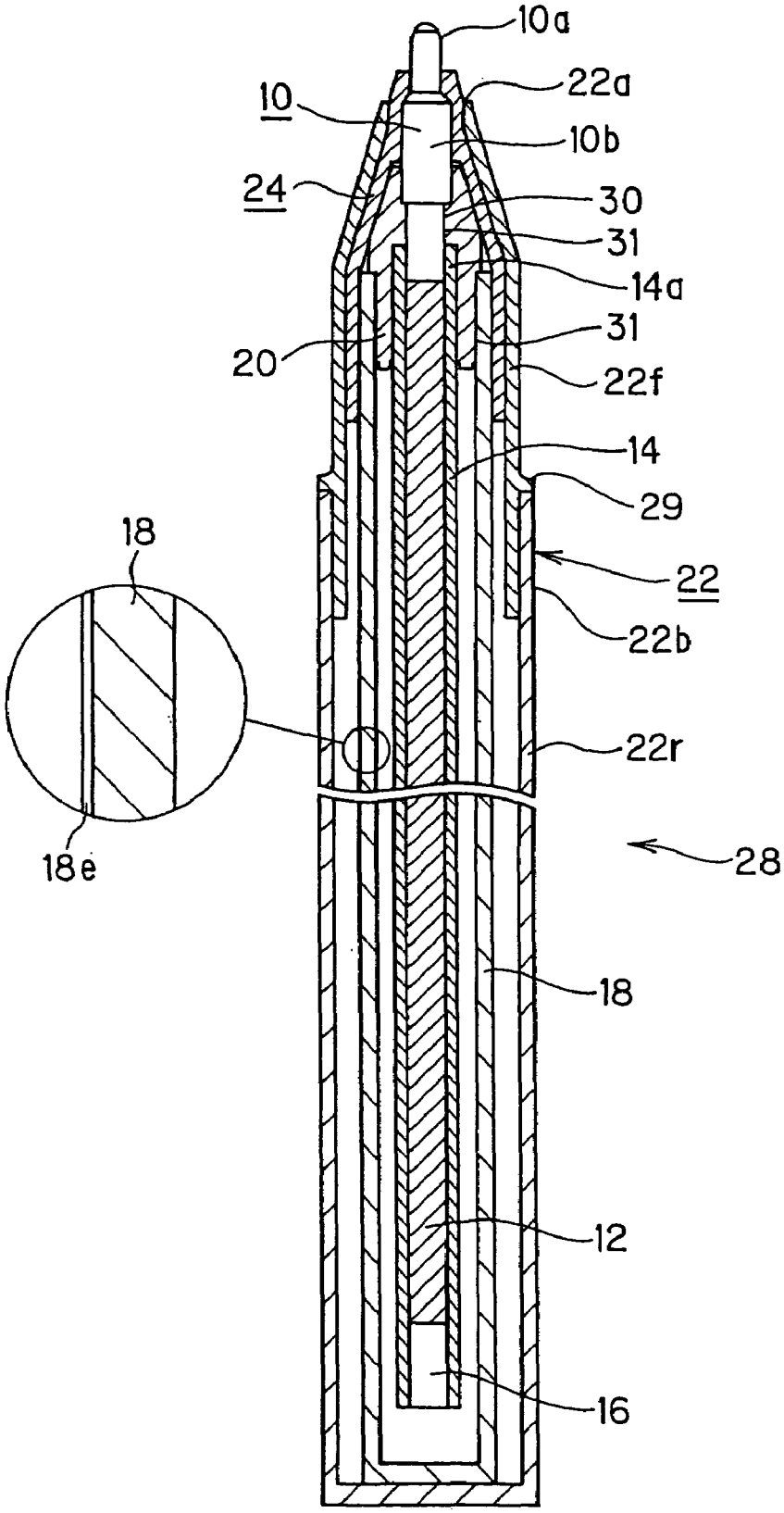
FIG. 7 is a vertical sectional illustrative view showing a gas-pressurized writing instrument to which an embodiment 6 of the present invention is applied.

FIG. 7 shows an embodiment 6 of a gas-pressurized writing instrument in which a moisture-proof layer 18*e* is formed over the entire outer surface of a casing cylinder 18 by transfer, printing, coating, or deposition. In this way, moisture-proof layer 18*e* can be formed in entirety, but it may also be formed partially. In this case, it is preferably formed in a grip portion 32 held by hand and fingers.

Moisture-proof layer 18*e* is also formed on the outer surface of a joint member 20. It is preferred that moisture-proof layer 18*e* is formed in entirety, but it may and should be formed, at least, at positions exposed to external air.

As the material for moisture-proof layer 18*e* on the outer surface of the casing cylinder 18, polypropylene (PP), polyethylene (PE), polyethylene terephthalate (PET), polybutylene terephthalate (PBT), modified polyphenylene ether (m.PPE), polyethylene naphthalate (PEN), vinylidene chloride, paraffin and the like can be considered. Particularly, when transfer is used polypropylene (PP) and polyethylene (PE) are preferred because they are easy to form film.

The suitable thickness of moisture-proof layer 18*e* is 0.2 to 2.0 mm. If thinner than 0.2 mm, it presents poor moisture resistance and formability. If thicker than 2.0 mm, the barrel is too thick in diameter, causing uncomfortable feeling in use and presenting poor transparency. Preferably, the thickness is 0.4 to 1.0 mm and more preferably 0.5 to 0.8 mm.

Preferred techniques of forming moisture-proof layer 18*e* in various ways are as follows.

When transfer is used, a film of metal or an inorganic layer, for example, is laminated. When printing is used, a gas barrier support with metal or inorganic material is printed. When coating is used, polypropylene or cyclic polyolefin is coated. A wax may be coated. Waxes are preferred because they will not be limited very much by the type of material to be coated (transfer etc., have the problem of peeling depending on the type of the material to be treated). Here, waxes indicate organic materials that are solid at normal temperature and become a liquid of a low viscosity when heated. For example, natural waxes, i.e., animal and vegetable waxes, mineral waxes and petroleum wax extracted from petroleum (paraffin wax, microcrystalline wax, petrolatum), and synthetic waxes such as fisher-tropsch wax and polyethylene wax may be used. For deposition, aluminum or other metal is evaporated or overcoated. Alternatively, inorganic material such as silicon oxide and the like is evaporated or overcoated.

The other configuration is basically the same as embodiment 1 shown in FIG. 1.

Furthermore, in a gas-pressurized writing instrument including: a tube member 14 which is made of a material that presents low gas permeability or gas impermeability, has a writing point assembly 10 at the front end thereof and is closed at the rear end to store ink 12 therein to be fed to the writing point assembly 10; and a compressed gas sealed in the tube member 14, a moisture-proof layer 18*e* may be formed on at least part of the outer surface of the tube member by transfer, printing, coating or deposition. An embodiment 9 realizing this structure is shown in FIG. 9(*c*). Also in this case, moisture-proof layer 18*e* may be formed either entirely or in the area in contact with the exterior air alone. The moisture-proof layer may be formed partly. In this case, it is preferably formed in a grip portion 32.

Figure 8:
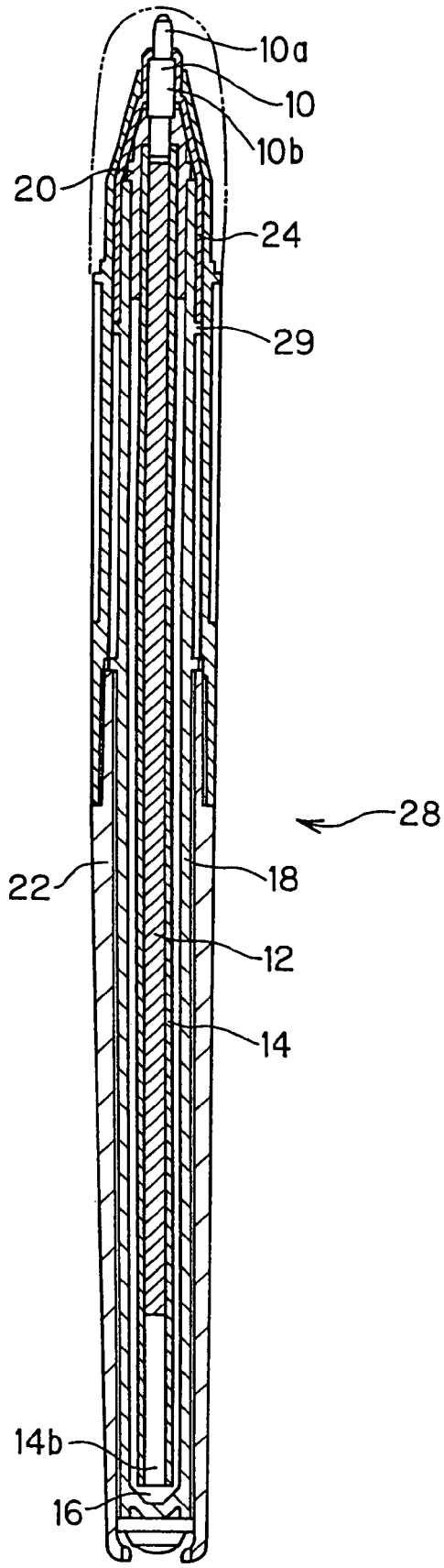
FIG. 8 is a vertical sectional illustrative view of a gas-pressurized writing instrument, depicting the writing instrument of embodiment 1 of the present invention, in a more specific manner.

FIG. 8 shows the writing instrument of the embodiment 1 in a more specific manner, wherein the writing point assembly, the tube member and the casing cylinder are integrated forming a refill that can be detachably fitted into an exterior member 22 forming the barrel cylinder of a writing instrument.

Embodiment 10

Figure 10:
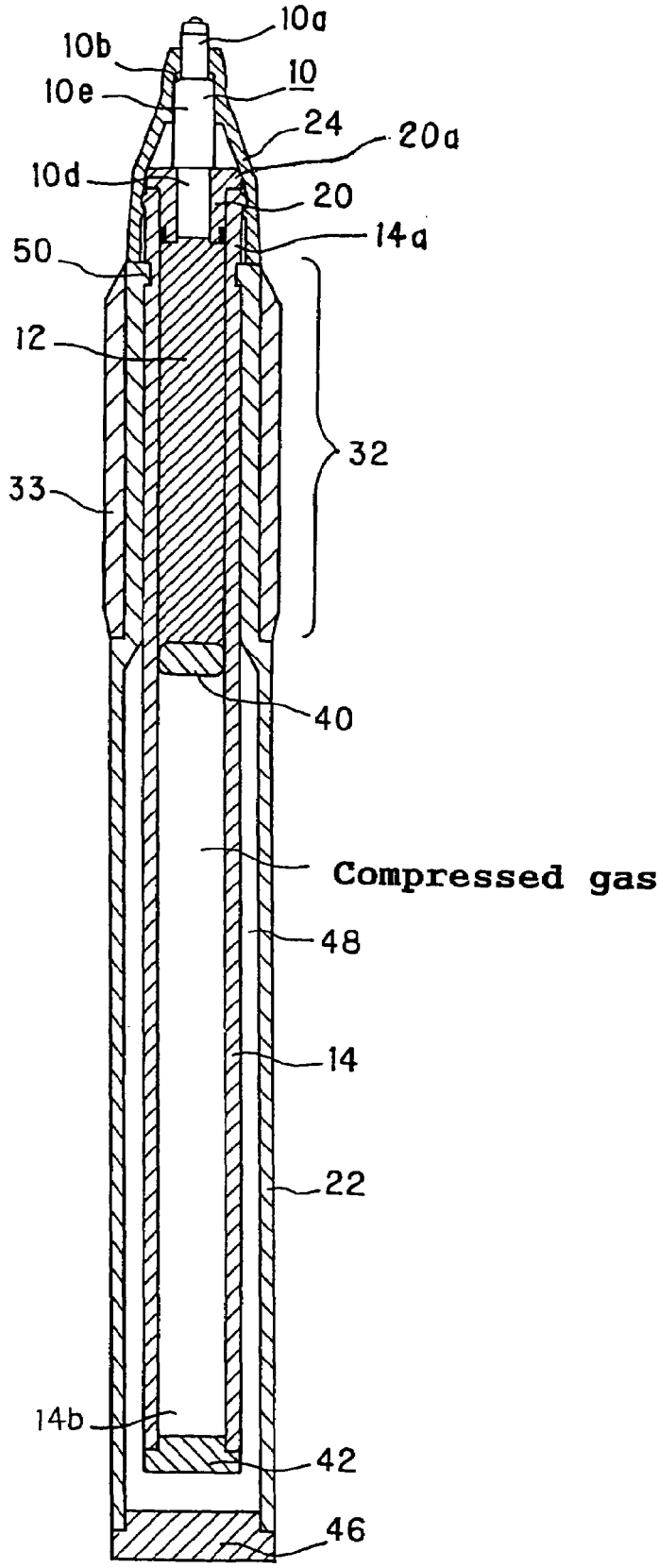
FIG. 10 is a vertical sectional illustrative view showing a gas-pressurized writing instrument to which an embodiment 10 of the present invention is applied.
Figure 12:
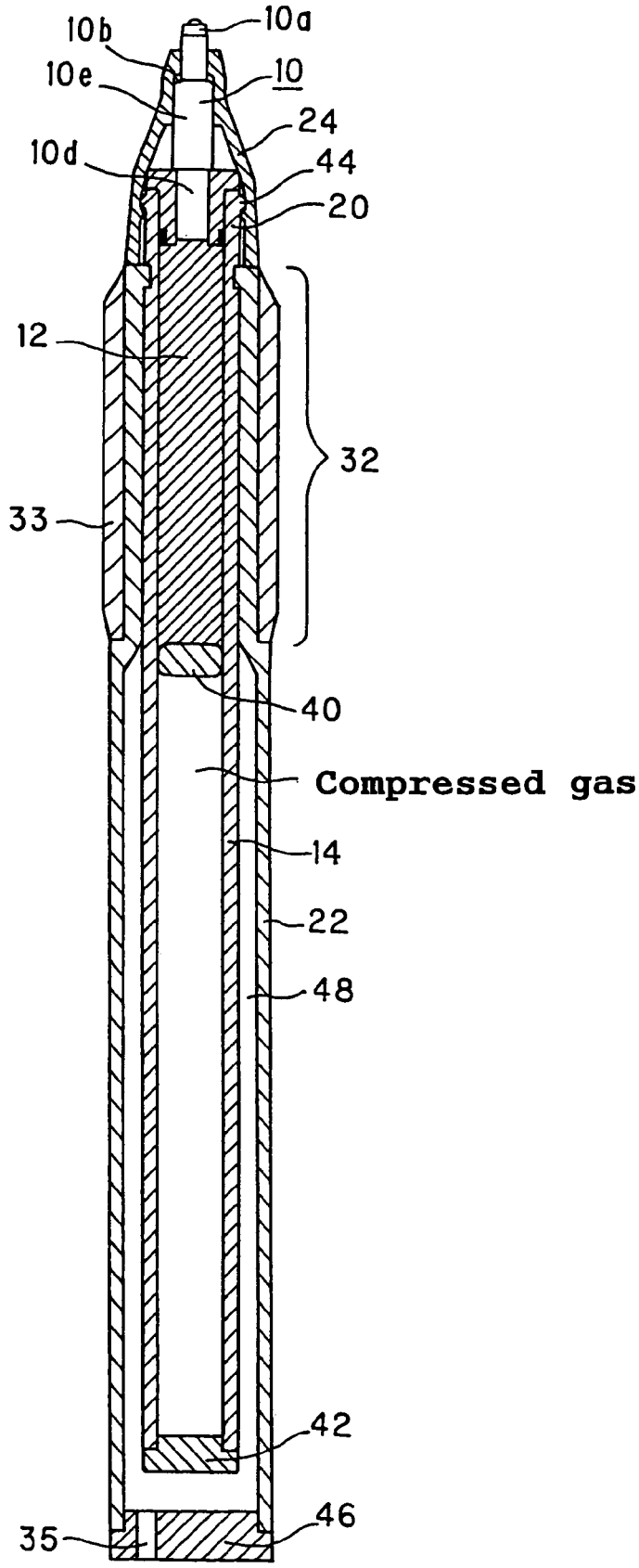
FIG. 12 is a vertical sectional illustrative view showing a gas-pressurized writing instrument to which an embodiment 11 of the present invention is applied.

FIG. 10 is a vertical sectional view showing a gas-pressurized writing instrument to which an embodiment 10 of the present invention is applied; FIG. 11 is a partial vertical section of this gas-pressurized writing instrument; and FIG. 12 is a vertical sectional view showing a gas-pressurized writing instrument to which an embodiment 11 of the present invention is applied. In the gas-pressurized writing instruments according to the embodiments 10 and 11, a compressed gas is charged and sealed in a tube member 14.

As shown in FIGS. 10 and 11, the embodiment 10 is a gas-pressurized writing instrument including: an elongate, cylindrical or tubular resin tube member 14 made of a gas impermeable or low-permeable material, which has a writing point assembly 10, made of metal or preferably a gas impermeable or low-permeable resin, holding a writing ball at the front end thereof and disposed at a front end 14*a* of the tube member and is closed at the rear end for storing therein an ink 12, selectable from various types such as oil-based ink, water-based ink, thixotropic ink and the like, to be supplied to the writing point assembly 10 (a follower or float 40 for prevention against backward leakage of ink may be provided as desired at the ink rear end); and a compressed gas (e.g., dry air or nitrogen gas) charged and sealed in the rear ink space in the tube member 14 (the space between ink rear end, the follower or float, and a tail plug 42).

This gas-pressurized writing instrument is formed with an exterior member 22 which covers the remaining part other than front end 10*a* of the writing point assembly 10 and the front end part of the tube member 14 (an example of "at least part of").

In this gas-pressurized writing instrument, as will be detailed later, writing point assembly 10 is provided at front end 14*a* of tube member 14 by way of a joint member 20. Further, a point assembly holder 24 is provided covering the periphery of the front end 14*a* of tube member 14, joint member 20 and writing point assembly 10 except its front end 10*a*. Also, exterior member 22 as a constituent of a barrel cylinder 28 of the gas-pressurized writing instrument is provided covering the tube member 14.

In this gas-pressurized writing instrument according to this embodiment 10, in order to attach writing point assembly 10 at the front end 14*a* of the tube member 14 having a rear opening 14*b* closed with a tail plug 42, joint member 20 for keeping the interior of tube member 14 airtight is provided between front end 14*a* of the tube member and writing point assembly 10 (in this embodiment joint member 20 is joined so as to hold writing point assembly 10 and tube member 14 in an airtight and liquid-tight manner). This joint member 20 is formed of a material that presents low gas permeability or gas impermeability. Here, the concept of 'joining' includes fitting, bonding, welding and the like.

Joint member 20 has a hollow, approximately cylindrical configuration (having a passage hole 30 penetrating therethrough) having a front end portion 20*a* enlarged flange-like, and most part of it other than the front end portion 20*a* sinks into the interior from the front end 14*a* of the tube member. The flange-like front end portion 20*a* abuts the front end 14*a* of the tube member so that it will not sink into tube member 14*a* more deeply. Specifically, writing point assembly 10 is not directly inserted into tube member 14 but (its reduced diametric portion 10*d* at the rear end) is fitted in passage hole 30 of joint member 20, and this joint member 20 in turn is fitted into the opening at front end 14*a* of tube member 14, so as to secure airtightness and liquid-tightness between the front end 14*a* of the tube member and writing point assembly 10.

Here, FIG. 11 detailedly shows joint member 20 and its vicinity. As shown in FIG. 11, point assembly holder 24 is arranged to cover writing point assembly 10, joint member 20 and front end 14*a* of the tube member while it exposes the front end 10*a* of writing point assembly 10 to the outside. Point assembly holder 24 is composed of a hollow, tapered front part narrowing towards the front end and an approximate cylindrical rear part. Writing point assembly 10 has a step, namely, point assembly abutment 10*b* formed therein, from which a large-diametric portion 10*e* having an outside diameter greater than that of writing point assembly front end 10*a* is formed. Point assembly holder 24 has a stopper portion 24*a* which, when writing point assembly front end 10*a* is fitted in its front opening, can abut the point assembly abutment 10*b* to limit forward movement of writing point assembly 10. The point assembly holder 24 is arranged at the front side of exterior member 22 (on the writing point assembly 10 side) so as to allow the front end 10*a* of writing point assembly 10 to front to the outside. More detailedly, writing point assembly 24 is engaged with tube member 14 while it covers the joint between writing point assembly 10 and joint member 20 and the joint between tube member 14 and joint member 20 so as to allow the front end 10*a* of writing point assembly 10 to front to the outside. Here, point assembly holder 24 may be engaged with joint member 20. In the case where point assembly holder 24 is engaged with joint member 20, it is preferred that the joined portion between writing point assembly 10 and joint member 20 is covered by point assembly holder 24. If tube member 14 is joined to writing point assembly 10 without provision of joint member 20, it is preferred that the joined area is covered by point assembly holder 24. Provision of point assembly holder 24 makes it possible to prevent the writing point assembly from rushing out as a result of compressed gas.

Further, a reduced diametric portion 10*d* having a smaller diameter than a large-diametric portion 10*e* is formed in the rear of writing point assembly 10. This reduced diametric portion 10*d* borders on large-diametric portion 10*e* located in front at a step 10*c* and has a smaller diameter than the large-diametric portion 10*e*. Reduced diametric portion 10*d* is not limited to being formed step-wise from the step 10*c*, but can be formed so as to taper or so that the diameter gradually becomes smaller.

This reduced-diametric portion 10*d* is fitted in passage hole 30 of joint member 20, and the joint member 20 is in turn fitted and fixed to tube member 14 (the reduced diametric portion 10*d* is inserted and fixed to tube member 14 by means of joint member 20). Further, reduced diametric portion 10*d* and the inner peripheral surface of passage hole 30 in joint member 20 are welded by heat and join so as to keep airtightness (airtight sealed joint 31). The outer peripheral surface of joint member 20 and the inner peripheral surface of tube member 14 are welded by heat and join, so as to keep airtightness (airtight sealed joint 31). These joints also prevent writing point assembly 10 from coming off from tube member 14. In a case where no joint member 20 is provided, tube member 14 may be directly jointed to the reduced diametric portion 10*d*.

Joining of joint member 20 or tube member 14 to reduced diametric portion 10*d* provides the following effect.

Generally, it is preferred for a writing instrument that the size of the parts disposed around writing point assembly 10 is smaller (it is preferred that the parts become smaller as they approach the writing point). If a large-diametric part is arranged, the part interferes with the field of view, so that the user cannot have clear vision of the writing point (low visibility) when writing. It is also unpreferable in view of appearance because of the loss of stylishness.

When joint member 20 or tube member 14 is joined, it may be joined to large-diametric portion 10*e*. However, large-diametric portion 10*e* is located closer to the writing point and is also greater in diameter. Therefore, if joined to the large-diametric portion 10*e*, joint member 20 or tube member 14 is positioned closer to the writing point, so that these parts may obstruct the visibility of the writing point when writing. It is also unpreferable in view of appearance because of the loss of stylishness.

Provision of reduced diametric portion 10*d* having a smaller diameter at the rear of writing point assembly 10 and joining of joint member 20 or tube member 14 to the reduced diametric portion 10*d* make the writing point visible and also provide stylishness in appearance.

Further, a metallic ring 25 is provided between joint member 20 and tube member 14, so that the ring 25 is heated by induction heating (electromagnetically) to thereby fuse joint member 20 and tube member 14 and cool them down to achieve joining (welding) to establish airtightness.

A clearance d is provided between engaging portion 24*a* of point assembly holder 24 and point assembly abutment 10*b*. In this embodiment, if joint member 20 and others swell or expand due to moisture absorption, the step or point assembly abutment 10*b* abuts engaging portion 24*a* of point assembly holder 24, causing a risk of point assembly holder 24 coming off. In this case, it is difficult to prevent an accidental rushing of writing point assembly 10 due to compressed gas. To deal with this, in the present embodiment, clearance d is provided aiming at prevention against the above problem resulting from the action of the step or point assembly abutment 10*b* abutting against engaging portion 24*a* of point assembly holder 24. Here, in point assembly holder 24 and tube member 14, point assembly holder rear coupling 44*b* and tube member rear coupling 44*a* are formed respectively, so that these couplings 44*a* and 44*b* ride and pass over each other to complete engagement.

Though, in the present embodiment joint member 20 and tube member 14 are joined by welding with heat, the rear couplings 44 are disposed at a different position away from the joint (explicitly, at a position to the front of the joint). Here, rear couplings 44 indicate the structures formed on the tube member 14 and joint member 20 for engagement of the point assembly holder 24, such as point assembly holder rear coupling 44*b* and tube member rear coupling 44*a*. Specifically, these are formed of engaging projections and indentations.

When joint member 20 and tube member 14 are joined together by heat welding, there is a high risk of tube member 14 etc., being thermally deformed. If point assembly holder 24 is engaged at such a place, there are cases where a sufficient strength of engagement cannot be obtained. Arrangement of rear couplings 44 at a position other than the joint provides a high enough coupling strength of point assembly holder 24.

Illustrated in the present embodiment is a configuration in which joints (tail plugs 42 and 46) having joining strengths smaller than the joining strength at the joints with writing point assembly 10 are constructed. Examples of the joints with writing point assembly 10 include that between writing point assembly 10 and joint member 20, that between writing point assembly 10 and tube member 14.

In this embodiment, joints having a joining strength smaller than these joints are formed. Such a joint may be one where tail plug 42 is provided for tube member 14, or one where tail plug 46 is provided at the rear end of exterior member 22. It is also possible to consider a configuration where a rear opening of tube member 14 or a hole in exterior member 22 is filled up with an adhesive or resin. As the method of making difference in joining strength, for example, changing the amount of adhesive, changing the deformed amount when fitting, differentiating the size of the joining area and other methods can be considered. The present embodiment shows a configuration where tail plug 42 is provided at the rear of tube member 14 while tail plug 46 is provided at the rear of exterior member 22. Joining strengths at the joint between tail plug 42 and tube member 14 and at the joint between tail plug 46 and exterior member 22 are set to be smaller than the joining strength at the joint between writing point assembly 10 and joint member 20. Thus, this setting causes any other joint than that with writing point assembly 10 to break away so as to discharge the compressed gas outside even if the gas-pressurized writing instrument is heated. As a result, it is possible to reduce the pressure acting on writing point assembly 10 and reduce the risk of writing point assembly 10 bursting and/or ink 12 surging out due to pressure. Here, the joining strength is measured by applying a tensile force in the axial direction to the joint.

Here, point assembly holder 24 may not only be transparent but also be colored to be opaque or translucent. This enables ink smudges inside the writing instrument (the rear part of writing point assembly 10 is principally prone to smudge during assembly) not to be seen from the outside, producing improvement in beauty and appearance quality. Further, opaque or translucent coloring enables color indication. In this case, the color is preferably made to correspond to the color of ink.

It should be noted that tube member 14 may be disposed inside joint member 20. Fixture of joint member 20 as well as fixture between other parts is not limited to fixture by welding, but fitting, bonding and other fixing means can be considered. Also, the joint member may be formed using two-color molding. As an adhesive for bonding, those having sealing performance are preferred, and examples include polyvinyl alcohol solution, two-part epoxy, hot melt and others. When bonding is used, in order to secure the necessary gas barrier performance, bonding is made in combination with undercut sealing (fitting). It should be noted that it is very difficult to select an adhesive that has both sealing performance and adhesiveness. Therefore, it is preferred that joining be done by welding.

Most part of the periphery of tube member 14 is covered by moisture-proof exterior member 22. Preferably, the entire part of the tube member 14 is covered by moisture-proof exterior member 22. This exterior member 22 has a one-piece approximately cylindrical configuration with its rear opening closed with a tail plug 46, and is tightly sealed with plug 46 at the rear opening. The hollow of exterior member 22 is formed smaller in diameter in the front part so that the interior surface adjoins the outer peripheral surface of tube member 14 while it is formed greater in diameter in the rear part so that the interior surface is spaced from the outer peripheral surface of tube member 14, forming a confined space 48 between the outer peripheral surface of tube member 14 and the inner peripheral surface of exterior member 22.

Exterior member 22 and tube member 14 are put together so as not to come off from each other by engagement (or fitting) of engaging portions 50 formed on both sides. For this anti-removal structure in the embodiment, engaging portion 50*a* on exterior member 22 is an inward projection while engaging portion 50*b* on tube member 14 is an inward recess. Other than projections and recesses, engaging portions 50 may be engaged by a similar structure to rear couplings 44 between joint member 20 and point assembly holder 24 where couplings 44*a* and 44*b* ride and pass over each other to complete engagement.

In gas-pressurized writing instrument shown in FIGS. 11 and 12 exterior member 22 is formed integrally. Other than this, exterior member 22 may have a separate configuration composed of front and rear parts, so that these parts encase tube member 14 and are integrated by screw fitting, crimping or bonding at the joint. In this separate configuration, it is advantageous, if possible, that the joint is sealed.

Production of gas-pressurized writing instruments can be made by forming tube member 14 and others with a material presenting low gas permeability or gas impermeability. Concerning the tube member, the casing cylinder or the joint member "formed of a material that presents low gas permeability or gas impermeability" in the present description, the entire tube member, the entire casing cylinder or the entire joint member may be formed of a single material that presents low gas permeability or gas impermeability; they may be formed of a mixture of a material that presents low gas permeability or gas impermeability and a material that does not present such properties, still presenting low gas permeability or gas impermeability; or their outer surface or inner surface may be formed with a layer of a material that presents low gas permeability or gas impermeability. In sum, any configuration will do as long as the compressed gas inside the tube member or in the casing cylinder has difficulty leaking out over a medium-term or long-term period.

Most of such materials that present low gas permeability or gas impermeability (e.g., ethylene vinyl alcohol copolymer (EVOH), polyvinyl alcohol (PVA), polyacryl nitrile (PAN), nylon) tend to increase gas permeability or permit gas to permeate therethrough as the ambient relative humidity increases. For example, ethylene vinyl alcohol copolymer (EVOH) presents a very high barrier performance when dried. However, as the relative humidity increases, the barrier performance lowers. Covering the periphery of tube member with moisture-proof exterior member 22 can prevent reduction in barrier performance. Concerning the extent the exterior member 22 covers, it is most preferred that the whole of the material that presents low gas permeability or gas impermeability is covered, but part of the material may be covered. If partially covered, preferably the area the user's hand comes into touch with, most preferably the holding portion (grip portion 32) should be covered.

Here, the exterior member 22 may be formed, as shown in FIG. 10, in a hermetic structure so as to isolate the interior (space 48) from ambient air. This makes it possible to improve thermal resistance and moisture resistance. The hermetic structure can be formed by joining (by fitting, bonding, welding or other methods) exterior member 22 with tube member 14, point assembly holder 24, joint member 20, tail plug 46 or the like.

Exterior member 22 should have greater thermal resistance or/and moisture resistance than that of tube member 14. In making choice of a low gas permeable or gas impermeable resin to be used for tube member 14 from various resin materials, it is necessary to consider the influence of a user's handsweat on the barrel when the user holds the writing instrument and writes with it. It is also necessary to consider a situation in which the writing instrument heats up as it is left on the top of the dashboard of an automobile. However, it is difficult to make choice of a resin material which meets the requirements of both low gas permeability and thermal resistance and moisture resistance. It is not so necessary to consider thermal resistance and moisture resistance when making choice of a material for tube member 14 into which gas will be sealed, from various resin materials presenting low gas permeability or gas impermeability, if exterior member 22 presents the necessary thermal resistance or moisture resistance. Thereby, the range of selection of the resin can be made wider and the functionality can be improved. Preferred examples of the resin to be used for exterior member 22 include polypropylene (PP), polyethylene (PE), polyolefin, cyclic polyolefin, polyethylene terephthalate (PET), polyethylene naphthalate (PEN), vinylidene chloride. Particularly, when the casing cylinder is formed of ethylene vinyl alcohol copolymer (EVOH), polypropylene (PP) and polyethylene (PE) resins are preferably used because these are excellent in thermal resistance, rigidity and adhesiveness. Further, it is also possible to enhance the moisture resistance and the interior visibility (light transmittance) for permitting easy monitoring of the remaining amount of ink therein while keeping up the gas barrier effect.

Though the exterior member 22 has a barrel cylinder structure, separated from tube member 14 (when exterior member 22 is given as a constituent of barrel cylinder 28), exterior member 22 is not limited to a configuration where it is separately provided from tube member 14 forming a space therebetween. That is, exterior member 22 can be formed (by two-color molding, deposition, laminating or other methods) so that it integrally covers the tube member 14 only or the whole part other than the front end 10*a* of writing point assembly 10.

Further, the wall of grip portion 32 of exterior member 22 at which the user holds, is made thicker than the other part of exterior member 22. The grip portion 32 that the user holds is most affected by handsweat of the user. If the wall thickness of this part is made greater than the other part of the exterior member, it functions to lessen the influence on the tube member 14 inside the exterior member. Enlargement of the wall thickness can be performed by not only merely increasing the wall thickness but also by attaching a grip 33 as a separate part as in the embodiment shown in FIGS. 10 and 11.

Further, when the writing instrument is heated for incineration or the like, the tube member 14 and exterior member 22 breakup first, so that the sealed gas will be released to the outside of the aforementioned space. The term "breakup" in this description indicates fusion, generation of breakage and cracks, formation of a hole, disconnection of a joint if any. Since a breakup of tube member 14 and exterior member 22 occurs first to discharge out the compressed gas, the pressure acting on writing point assembly 10 can be reduced, thus making it possible to reduce the risk of writing point assembly 10 bursting (rushing out).

In this case, point assembly holder 24 is preferably formed of a material having greater thermal resistance than tube member 14. Preferred examples include polypropylene (PP), polyethylene (PE), polybutylene terephthalate (PBT), cyclic polyolefin, polyethylene terephthalate (PET), polyoxymethylene (POM), polyethylene naphthalate (PEN) and polyvinyl chloride.

As the material for the tube member 14 and joint member 20, materials that have low gas permeability and gas impermeability, for example, ethylene vinyl alcohol copolymer (EVOH), nylon, transparent nylon and polyethylene terephthalate (PET) can be used. In particular, ethylene vinyl alcohol copolymer (EVOH) is preferred.

Because point assembly holder 24 serving as anti-removal for the writing point assembly 10 is provided and because the rigidity of tube member 14 and exterior member 22 drops at a predetermined temperature even under incineration after its life, so that gas leak occurs to release gas from the interior of tube member 14, there is no risk of writing point assembly 10 rushing out from the front of the writing instrument or the refill.

The compressed gas to be sealed in tube member 14 may employ nitrogen ($N_2$) gas or air. Dry nitrogen gas or dry air having a humidity of 60% (at 25 deg. C.) or lower is preferably used.

The volume of the compressed gas in tube member 14 is adjusted to be 2 to 10 times the volume of ink initially stored in tube member 14, and the pressure inside tube member 14 when almost all ink has been consumed at just before the end of writing life is adjusted to be 0.15 MPa to 0.6 MPa.

The reason the compressed gas volume relative to the ink volume is specified to be 2 to 10 times is that, if the volume of the compressed gas is lower than 2 times of the ink volume, it is impossible to obtain a sufficient pressure that forces ink out due to reduction of the ink volume when ink is used up by writing, and that the difference of the pressure at the life end from the initial pressure is too large, or the change in pressure is too large. On the contrary, if the ratio is set to be greater than 10 times, wasteful space is needed, resulting in increase in cost and giving rise to an appearance problem that the amount of ink is perceived to be relatively low.

The reason the pressure inside tube member 14 at the ink end when almost all ink has been used up is specified to be 0.15 MPa to 0.6 MPa is that, with a pressure lower than 0.15 MPa, it is difficult to obtain a smooth write feeling for lack of pressure to drive ink out, water is prone to enter into writing point assembly 10 when writing is performed on a wet sheet of paper or the like, and water is prone to penetrate into writing point assembly 10 when the writing instrument drops into water. On the other hand, with a pressure greater than 0.6 MPa, it is difficult to prevent ink leakage from the writing point.

It is preferred that at least part of the tube member 14 is formed of a transparent or translucent resin, in view of easy monitoring of the remaining ink. Further, for the same reason, at least part of exterior member 22 and point assembly holder 24 may also be formed to be transparent or translucent.

Further, since tube member 14 stores ink 12 therein, it is necessary to prevent degradation of gas impermeability or low gas permeability as a result of material degeneration by the ink. For this purpose a moisture-proof layer 52 is formed on its inner peripheral surface.

Here, as the material for moisture-proof layer 52 formed on the inner peripheral surface (inner surface) of the tube member 14, polypropylene (PP), polyethylene (PE), polyethylene terephthalate (PET), polybutylene terephthalate (PBT), modified polyphenylene ether (m.PPE), cyclic polyolefin, vinylidene chloride, paraffin and the like can be used for improvement of moisture-proof performance. Polypropylene (PP) and polyethylene (PE) are particularly preferred for two-color molding. When the tube member is formed of ethylene vinyl alcohol copolymer (EVOH), polypropylene (PP) and polyethylene (PE) resin are preferably used. This is because it is possible to enhance the moisture resistance and the interior visibility (light transmittance) for permitting easy monitoring of the remaining amount of ink therein while keeping up the gas barrier effect. Further, it is because these are also excellent in rigidity and adhesiveness.

Though the space 48 inside exterior member 22 is inherently desirable to be a confined space as in the above embodiment 10 shown with FIGS. 10 and 11, it is also possible, as in a gas-pressurized writing instrument according to an embodiment 11 shown with FIG. 12, to create a space 48 between the exterior member 22 and tube member 14 and provide a vent hole 35 communicating with the outside for exterior member 22 so that the space 48 communicates with the outside via vent hole 35. As a method of forming space 48, a groove may be formed on the inner surface of exterior member 22 or the outer surface of tube member 14. In the gas-pressurized writing instrument of embodiment 11, provision of space 48 between the exterior member 22 and tube member 14 in combination with provision of vent hole 35 that communicates with the outside for exterior member 22 enables smooth discharge of the compressed air leaking out when tube member 14 is broken up or for any other reason, hence prevents rush and other actions of writing point assembly 10 and ink 12.

The vent hole 35 is formed near the rear end of exterior member 22 (near tail plug 46 etc.). Since vent hole 35 is arranged at the rear end of exterior member 22 opposite to the joint with writing point assembly 10, it is possible to minimize the pressure acting on the front where writing point assembly 10 is located. It should be noted that exterior member 22 may be formed of a material that will decompose at a predetermined temperature. The other configuration is basically the same as embodiment 10.

The above tenth and eleventh embodiments are mainly formed of writing point assembly 10, tube member 14, joint member 20 and exterior member 22 so as to realize a simple, inexpensive configuration with a fewer number of parts by omitting the casing cylinder, from that of the above first to ninth embodiments. Yet, it is possible to select and apply appropriate materials and structures of the first to ninth embodiments to the materials of writing point assembly 10, tube member 14, joint member 20, exterior member 22 as well as to the materials and structures of the inner and outer layers etc., in order to improve the gas barrier performance, moisture-proof performance, interior visibility. It is also possible to adopt the material and structure of the inner and outer layers of the casing cylinders of the first to ninth embodiments and apply them to the tube member 14.

In the present invention, in the tenth and eleventh embodiments, it is possible to integrate writing point assembly 10, tube member 14, point assembly holder 24 to form a refill that can be detachably fitted into barrel cylinder 28 of a writing instrument including exterior member 22.

Further, writing point assembly 10, tube member 14, point assembly holder 24 and exterior member 22 may be integrated to form a refill.

INDUSTRIAL APPLICABILITY

According to the gas-pressurized writing instrument and writing instrument refill of the present invention, a simple arrangement, specifically, provision of gas barrier performance for the member in which a compressed gas is charged and sealed makes it possible to provide a gas-pressurized writing instrument and writing instrument refill which can prevent gas leakage.

A simple configuration wherein a gas barrier confined space is formed by a writing point assembly, a tube member and others while a compressed gas is charged and sealed in a space formed between the tube member and a casing cylinder, makes it possible to provide a highly safe, inexpensive gas-pressurized writing instrument and writing instrument refill, which are easy to manufacture.

Further, a simple configuration wherein a gas barrier layer is formed in a tube member, makes it possible to provide a gas-pressurized writing instrument and writing instrument refill, which can prevent gas leakage.

The invention claimed is:

1. A gas pressurized writing instrument comprising:

a tube member which has a writing point assembly at a front end, stores ink therein to be fed to the writing point assembly, and opens at a rear end;

a casing cylinder which is closed at its rear and encases at least part of the tube member, the casing cylinder creating a space between the tube member and the casing cylinder, the space communicating with the open rear end of the tube member, the casing cylinder being formed of a material that presents low gas permeability or gas impermeability;

a compressed gas sealed in the space between the tube member and the casing cylinder;

a joint formed of a material that presents low gas permeability or gas impermeability, the joint maintaining the space between the tube member and the casing cylinder airtight, the joint being provided between the casing cylinder and the writing point assembly to encase the tube member in the casing cylinder, keeping the tube member out of contact with outside air while a gas barrier layer that presents low gas permeability or gas impermeability is formed on at least part of an inner surface or an outer surface of the joint;

the writing point assembly being fitted into an interior hole formed in a front end of the joint and being welded thereto by heating; and a metallic ring provided between the joint and the casing cylinder, the ring being heated by induction heating to thereby fuse the joint and the casing cylinder, thereby establishing air tightness of the space between the tube member and the casing cylinder.

2. The gas-pressurized writing instrument according to claim 1, wherein the material for the gas barrier layer is ethylene vinyl alcohol copolymer (EVOH).

3. The gas-pressurized writing instrument according to claim 1, wherein a reduced diametric portion having a smaller diameter is formed in the rear part of the writing point assembly, and the rear end of the reduced diametric portion is fixed to the tube member while the joint is joined to the reduced diametric portion.

4. The gas-pressurized writing instrument according to claim 1, wherein airtight closure joint sites for keeping the space between the tube member and the casing cylinder airtight are disposed locally around the writing point assembly.

* * * * *